US007468483B2

(12) United States Patent
Yoshino

(10) Patent No.: US 7,468,483 B2
(45) Date of Patent: Dec. 23, 2008

(54) ELECTRONIC PERCUSSION INSTRUMENT AND DISPLACEMENT DETECTION APPARATUS

(75) Inventor: Kiyoshi Yoshino, Hammatsu (JP)

(73) Assignee: Roland Corporation, Hamamatsu (JP)

( * ) Notice: Subject to any disclaimer, the term of this patent is extended or adjusted under 35 U.S.C. 154(b) by 411 days.

(21) Appl. No.: 11/262,443

(22) Filed: Oct. 27, 2005

(65) Prior Publication Data

US 2006/0156910 A1 Jul. 20, 2006

(30) Foreign Application Priority Data

Jan. 19, 2005 (JP) ..... 2005-011255
Jan. 19, 2005 (JP) ..... 2005-011256

(51) Int. Cl.
*G10H 3/00* (2006.01)

(52) U.S. Cl. ..... 84/723; 84/600; 84/746; 84/104; 84/111; 84/411 R

(58) Field of Classification Search ..... None
See application file for complete search history.

(56) References Cited

U.S. PATENT DOCUMENTS 5,028,776 A * 7/1991 Forti et al. ..... 250/229
6,815,604 B2 * 11/2004 Toda ..... 84/746
7,015,391 B2 * 3/2006 Tomoda ..... 84/726
7,294,778 B2 * 11/2007 Susami ..... 84/723
2005/0145101 A1 * 7/2005 Yoshino ..... 84/723
2005/0150349 A1 * 7/2005 Susami ..... 84/299
2006/0096448 A1 * 5/2006 Yoshino et al. ..... 84/734
2006/0243117 A1 * 11/2006 O'Donnell ..... 84/422.3

FOREIGN PATENT DOCUMENTS

JP 2003-195857 A 7/2003

* cited by examiner

*Primary Examiner*—Marlon T Fletcher
(74) *Attorney, Agent, or Firm*—Foley & Lardner LLP

(57) ABSTRACT

An electronic percussion instrument with a single cymbal and a displacement detection apparatus that detects the displacement of an electronic cymbal. The electronic percussion instrument is designed to allows users to simulate the performance feel of an acoustic cymbal with two cymbals. The single cymbal of the instrument moves vertically in conformance with the depression of a pedal to simulate the "open" and "closed" positions of an acoustic cymbal. The displacement detection apparatus electronically detects the vertical displacement of the cymbal in the electronic percussion instrument through measuring resistance change of the detector in conformance with the movements of the cymbal.

23 Claims, 12 Drawing Sheets

ELECTRONIC PERCUSSION INSTRUMENT AND DISPLACEMENT DETECTION APPARATUS

BACKGROUND OF THE INVENTION

CROSS REFERENCE TO RELATED APPLICATIONS

This application claims priority to Japanese patent applications Nos. 2005-011255 filed on Jan. 19, 2005 and 2005-011256 filed on Jan. 19, 2005, all of which were assigned to the applicant and are incorporated herein.

FIELD OF THE INVENTION

Embodiments of the present invention relate, generally, to an electronic percussion instrument with a single cymbal capable of allowing a user to simulate the feel and experience (performance feel) of performing with an acoustic high hat cymbal during its operation, and a displacement detection apparatus capable of accurately detecting the displacement of an electronic cymbal.

RELATED ART

For some time, electronic high hat cymbals have been designed with the top cymbal capable of moving up and down in conformance with the amount that a pedal is depressed to simulate the performance feel of an acoustic high hat cymbal. To simulate the acoustic high hat cymbal that is structured with two cymbals, the electronic high hat cymbal that is disclosed in the Patent References and other electronic high hat cymbals of the same type use two cymbals.

For this kind of electronic high hat cymbal with two cymbals, the bottom cymbal is fixed in position, and the timbre of the high hat cymbal differs depending on the position of the top cymbal with respect to the bottom cymbal. For an electronic high hat cymbal, it is therefore necessary to detect the position of the top cymbal with respect to the bottom cymbal when the top cymbal is struck. The electronic high hat cymbal disclosed in the Patent References detects the position of the top cymbal with respect to the bottom cymbal by detecting the amount that a pedal has been depressed.

SUMMARY OF THE DISCLOSURE

Embodiments of the present invention goes beyond the conventional method of using two cymbals. Some embodiments of the present invention describe an electronic percussion instrument with a single cymbal that still maintains the performance feel of an acoustic high hat cymbal.

With the method described above in which the position of the top cymbal with respect to the bottom cymbal is detected by detecting the amount that a pedal is depressed, there is an error is between that amount and the displacement of the top cymbal since the position of the top cymbal is not detected directly. Embodiments of the present invention makes it possible to detect the displacement of the electronic cymbal more accurately, hence it makes the performance feel of the electronic cymbal more like the performance feel of an acoustic high hat cymbal.

In order to achieve this objective, the first preferred embodiment of the present invention provides an electronic percussion instrument comprising a single cymbal, a pedestal that a vertical shaft passes through, a striking surface of a flexible body that moves up and down in response to the movement of the vertical shaft, a first detection section that detects vibrations when the striking surface is struck, and a second detection section that detects the vertical displacement of said striking surface. The single cymbal comprises a first frame that supports said striking surface, and a second frame attached to the first frame, wherein the second frame forms the bottom surface opposite to said striking surface. In this embodiment, the cymbal is attached to the shaft and moves up and down in conformance with the movement of the shaft, and the shaft passes through the first and the second frames with the striking surface on top. In addition, a signal based on the detection results of the first and the second detection sections is output to a sound source system. The pedestal in this embodiment is fastened to the shaft at a position lower than that of the cymbal in a state that there is play. (The word "play" is used to mean freedom or room for movement.) When the cymbal moves downward in conformance with the movement of the shaft, the second frame is seated on the pedestal in the vicinity where the shaft passes through the second frame.

In a second preferred embodiment of the present invention, the electronic percussion instrument further comprises: a support section through which the shaft passes so that there is play, and a seating section of the second frame which sits on the pedestal section. In this embodiment, the support section has a broad base and a narrow apex, and the apex portion of said support section supports the first frame such that swinging is possible with respect to the shaft. Also, the seating section is curved on the side facing the pedestal section with a greater radius of curvature than that of the pedestal section. Furthermore, the support section is in the center of the seating section, and the pedestal section forms a hollow in the direction of the curvature of the seating section such that the pedestal section roughly approximates the outer shape of said seating section in the cross-section view.

In a third preferred embodiment of the present invention, the electronic percussion instrument of the second preferred embodiment further comprises a moving section through which the shaft passes such that there is play. In this embodiment, the moving section is positioned below the cymbal, the moving section moves downwards in conformance with the movement of the cymbal in those cases when the cymbal moves downward, and the second detection section detects the amount of movement of the moving section electrically.

In a fourth preferred embodiment of the present invention, the electronic percussion instrument of the third preferred embodiment further comprises an adjusting section that can be adjusted so that the second detection section detects a specified value in those cases where the seating section has been seated on the pedestal section.

In a fifth preferred embodiment of the present invention, the electronic percussion instrument of the fourth preferred embodiment further comprises a contact section through which the shaft passes such that there is play. In this embodiment, the contact section can move up and down in conformance with the movement of the cymbal, during which it comes into contact with the moving section. The adjusting section is structured so that the contact section can move up and down along the shaft relative to the cymbal and the moving section.

In a sixth preferred embodiment of the present invention, the electronic percussion instrument of the fifth preferred embodiment further comprises: a rotation control section mated with the lower portion of the support section to prevent the rotation of the support section with the shaft at the center, wherein the shaft passes through the rotation control section such that there is play; an impelling section that impels the support section upward with respect to the rotation control section; a cylindrical section that extends from the rotation control section that passes through the support section and the cymbal such that there is play, wherein the shaft passes through the inside of the cylindrical section such that there is play; and, a securing section screwed onto the side of the cylindrical section opposite of the rotation control section such that the securing section holds the cymbal between the support section and the securing section. In this embodiment, the contact section is engaged with said rotation control section.

In a seventh preferred embodiment, the adjusting section of the electronic percussion instrument of the fourth preferred embodiment is configured such that the pedestal can move up and down along the shaft relative to the cymbal and the moving section.

In an eighth preferred embodiment, the electronic percussion instrument of the third preferred embodiment is structured so that the second frame of the cymbal is connected to the first frame such that an interior space is formed between the second frame and the first frame. In this embodiment, and the first detection section is located on the inner surface of the second frame.

In a ninth preferred embodiment, the electronic percussion instrument of the third preferred embodiment further comprises: a rolling section fastened to the moving section; a first impelling section with which the moving section is impelled toward the cymbal; and, a second impelling section with which the rolling section is impelled toward the contact surface. In this embodiment, the rolling section moves in conformance with the movement of the moving section while rolling on a contact surface of the second detection section. Thus, the position of the rolling section on the contact surface can be detected electrically through the contact between the rolling section and the contact surface of the second detection section.

In a tenth preferred embodiment, the moving section of the electronic percussion instrument of the third preferred embodiment further comprises a first actuator which can rotate with the shaft as the center when the moving section is in contact with the cymbal, and a second actuator that, while supporting the first actuator, cannot rotate with the shaft as the center.

In an eleventh preferred embodiment, the electronic percussion instrument of the tenth preferred embodiment is one in which the rolling section is fastened to the second actuator of the moving section.

In a twelfth preferred embodiment, the electronic percussion instrument of the tenth preferred embodiment further comprises a coil spring that impels the second actuator toward the first actuator, wherein the coil spring is attached to the second actuator in a twisted state such that it impels the rolling section toward the contact surface of the second detection section. In this embodiment, the first impelling section and the second impelling section are engaged by the coil spring.

In a thirteenth preferred embodiment, the second detection section of the electronic percussion instrument of the ninth or tenth embodiment comprises: a top sheet on which there is a first conducting pattern on the surface opposite to the contact surface; a base sheet on which there is a second conducting pattern that shunts the first conducting pattern on the surface facing the surface of the first conducting pattern of the top sheet; and, a spacer sheet sandwiched between the base sheet and the top sheet and is placed between the first conducting pattern and the second conducting pattern. In this preferred embodiment, the electrical resistance of the second detection section changes in conformance with a change of the position of where the rolling section comes into contact with the contact surface.

A fourteenth preferred embodiment provides a displacement detection apparatus that detects the displacement of an electronic cymbal in a first direction comprising: a moving section that is in contact with the electronic cymbal and moves in the first direction in conformance with the movement of the electronic cymbal; a rolling section that is attached to the moving section and moves while rolling up and down on a contact surface in conformance with the movement of the moving section; a detection section that comprises the contact surface that is in contact with the rolling section, which detects the position of the rolling section on the contact surface electrically; a first impelling section that impels the moving section in a direction opposite to the first direction; and, a second impelling section that impels the rolling section in the direction of the contact surface.

In a fifteenth preferred embodiment, the moving section of the displacement detection apparatus of the fourteenth embodiment further comprises a first actuator that can rotate around a central axis, wherein the central axis is in the same direction as the first direction which the cymbal moves in.

In a sixteenth preferred embodiment, the rolling section of the displacement detection apparatus of the fifteenth preferred embodiment is fastened to the second actuator of the moving section.

In a seventeenth preferred embodiment, the displacement detection apparatus of the fifteenth preferred embodiment further comprises a coil spring that impels the second actuator toward the first actuator. In this embodiment, the coil is connected to the second actuator in a twisted state to impel the rolling section toward the contact surface. In this embodiment, the first impelling section and the second impelling section are engaged by the coil spring.

In an eighteenth preferred embodiment, the detection section of the displacement detection apparatus of the fourteenth embodiment further comprises: a top sheet on which there is a first conducting pattern on the surface opposite to the contact surface; a base sheet on which there is a second conducting pattern that shunts the first conducting pattern on the surface facing the surface of the first conducting pattern of the top sheet; and, a spacer sheet that is sandwiched between the base sheet and the top sheet and is placed between the first conducting pattern and the second conducting pattern. In this embodiment, the electrical resistance of the second detection section changes in conformance with a change of the position of where the rolling section comes into contact with the contact surface.

In a nineteenth preferred embodiment, the electronic cymbal of the fourteenth embodiment comprises a striking surface that can be struck by the performer, a first frame that supports the striking surface, and a second frame that is connected to the first frame and forms the bottom surface opposite the striking surface. In this embodiment, the first frame and the second frame forms as a single unit, a shaft passes through the first and second frames with the striking surface on top, and the cymbal moves up and down in conformance with the movement of the shaft. Furthermore, the moving section comes into contact with the cymbal and moves downward in conformance with the movement of the cymbal in those cases when the cymbal has moved downward in conformance with the movement of the shaft.

Since the electronic percussion instrument of the first preferred embodiment is structured with a single cymbal, this has advantages of a reduced number of components and a reduced manufacturing cost compared to an instrument with two cymbals as designed in the past. In addition, since the instrument comprises a pedestal on which the center of the second frame of the cymbal is seated, there is an advantage of still being able to simulate the performance feel of an acoustic high hat cymbal even though the electronic percussion instrument is structured with a single cymbal.

In addition to the advantages of the first preferred embodiment, since the electronic percussion instrument of the second preferred embodiment is further comprised of a support section that has a broad base and narrow apex, and that the seating section of the second frame which sits on the pedestal is structured curved on the pedestal section side with a greater radius of curvature, and that the pedestal section forms a hollow in the direction of the curvature of the seating section such that the pedestal roughly approximates the outer shape of the seating section in the cross-section view, there is an advantage that when the cymbal is struck in a closed state or when the cymbal becomes closed in the midst of swinging, the cymbal gradually becomes level while swinging to the right and to the left. This makes the simulation of the performance feel of an acoustic high hat cymbal even more faithful.

In addition to the advantages of the second preferred embodiment, since the second detection section of the third embodiment electrically detects the displacement of the moving section that moves downward in conformance with the movement of the cymbal in those cases where the cymbal has moved downward, there is an advantage that the vertical displacement of the striking surface can be detected through detecting the amount of movement of the moving section.

Since the electronic percussion instrument of the fourth preferred embodiment further comprises an adjusting section that is adjusted so that the second detection section detects a specified value in those cases where the seating section has been seated on the pedestal section, there is an advantage that individual adjustments can be easily made to the value detected by the second detection section when the seating section has been seated on the pedestal.

In addition to the advantages of the fourth embodiment, since the adjusting section in the electronic percussion instrument of the fifth embodiment is structured so that the contact section can move up and down along the shaft relative to the cymbal and the moving section, and that the adjustment of the contact section height with respect to the cymbal and the moving section is a simple operation, there is an advantage that individual adjustments to the value detected by the second detection section when the seating section is seated on the pedestal can be made discretely.

In the sixth preferred embodiment, since the securing section that is screwed onto the cylindrical section is located on the cymbal side, the rotation control section that is connected to the other side of the cylindrical section is pushed upward against the impelling section. That is to say, since the cylindrical section passes through the cymbal and the support section and the moving section is separated from the cylindrical section, it is possible for the rotation control section to be moved relatively upward with respect to the cymbal, the support section, and the moving section. On the other hand, when the securing section is moved toward the side that is opposite that of the cymbal, the rotation control section is pushed downward by the impelling section. That is to say, in the same manner as has been discussed above, it is possible for the rotation control section to be moved relatively downward with respect to the cymbal, the support section, and the moving section.

In the seventh preferred embodiment, the adjusting section is structured such that it is possible to move the pedestal vertically along the shaft with respect to the cymbal and the moving section. Because such a height adjustment to the pedestal is a simple operation, there is an advantage that individual adjustments of the value detected by the second detection section in those cases where the seating section has been seated on the pedestal can be made discretely.

In the electronic percussion instrument of the eighth preferred embodiment, the first detection section is arranged on the inner surface of the second frame. Hence, there is an advantage that the sensitivity to the vibrations of the striking surface is more uniform no matter where the striking surface is struck, compared to the case in which the detection section is arranged on the inner surface of the first frame that supports the striking surface.

In the electronic percussion instrument of the ninth preferred embodiment, the moving section is in contact with the cymbal and moves in conformance with the movement of the cymbal. Hence, the displacement of the cymbal can be detected by the detection section through the electrical position detection of the rolling section, which is fastened to the moving section and rolls on the contact surface in conformance with the movement of the moving section. Therefore, there is an advantage that direct detection of the cymbal displacement is possible, and the displacement of the cymbal can be detected more accurately. In addition, since the instrument further comprises a first impelling section that impels the moving section toward the cymbal, there is the advantage that by the utilization of the impelling force, it is possible to automatically move the moving section to the initial position in those cases where the cymbal has moved downward. Furthermore, since the instrument further comprises a second impelling section that impels the rolling section toward the contact surface, there is an advantage that the rolling section is pressed against the contact surface and this makes possible the accurate detection of the position of the rolling section on the detection section.

In the electronic percussion instrument of the tenth preferred embodiment, the moving section further comprises a first actuator that can rotate with the shaft as a center while in contact with the cymbal, and a second actuator that cannot rotate with the shaft as a center while supporting the first actuator. This has an advantage that even when the cymbal rotates with the shaft as a center and the first actuator in contact with the rotating cymbal, the transmission of the rotational force to the second actuator is suppressed and the rotational force is absorbed by the first actuator.

In the electronic percussion instrument of the eleventh preferred embodiment, the rolling section is fastened to the second actuator in the moving section. Since the second actuator is attached so that the second actuator cannot rotate with the shaft as the center even when the cymbal and the first actuator rotate, there is an advantage that the detaching of the rolling section from the contact surface through the rotation of the second actuator can be prevented.

In the electronic percussion instrument of the twelfth preferred embodiment, since the first impelling section and the second impelling section are both engaged by a common coil spring, there are advantages of a reduced number of components and reduced manufacturing cost, while still achieving the objective of attaching the second actuator so that the actuator cannot rotate.

In the electronic percussion instrument of the thirteenth preferred embodiment, when the first conducting pattern of the top sheet is pressed onto the second conducting pattern of the base sheet by the rolling section through the intervening spacer sheet, the first conducting pattern and the second conducting pattern are shunted in the position in which contact has been made. Therefore, the electrical resistance of the second detection section changes in conformance with the location that is pressed by the rolling section, which moves in conformance with the movement of the cymbal. Hence, there an advantage that the displacement of the rolling section can be detected by measuring the change in the electrical resistance and, as a result, this enables the electrically detection of the displacement of the electronic cymbal.

In the displacement detection apparatus of the fourteenth preferred embodiment, the displacement of the electronic cymbal, which moves in the first direction, is detected electrically through the detection by the detection section. This is accomplished through detecting the position of the rolling section that is fastened to the moving section and that rolls on the contact surface of the detection section in conformance with the movement of the moving section, wherein the moving section comes into contact with the electronic cymbal and moves in the first direction in conformance with the movement of the electronic cymbal. Therefore, there is an advantage that the displacement of the electronic cymbal can be detected directly and more accurately. In addition, since the apparatus further comprises a first impelling section that impels the moving section in a direction opposite to the first direction, there is an advantage that, by utilizing the impelling force, it is possible to automatically move the moving section to the initial position in those cases where the electronic cymbal has been moved in a direction opposite to the first direction. Furthermore, since the apparatus further comprises a second impelling section that impels the rolling section toward the contact surface, there is an advantage that the rolling section can be pressed onto the contact surface to enable the accurate detection of the position of the rolling section on the detection section.

In addition to the advantages of the fourteenth preferred embodiment, the moving section of the fifteenth preferred embodiment further comprises a first actuator that can rotate with the central axis as the center when in contact with the electronic cymbal and a second actuator that cannot rotate with the central axis as the center while supporting the first actuator. In this embodiment, the central axis is in the same direction as the first direction. Hence, there is the advantage that when the electronic cymbal rotates with the central axis as the center, the first actuator in contact with the electronic cymbal also rotates with the electronic cymbal. Thus, the rotational force is absorbed by the first actuator, and the transmission of the rotational force to the second actuator is suppressed.

In the displacement detection apparatus of the sixteenth preferred embodiment, since the rolling section is fastened to the second actuator in the moving section, there is the advantage that even when the electronic cymbal and the first actuator have rotated with the central axis as the center, the second actuator is attached such that rotation around the central axis is not possible. Thus it is possible to prevent the detachment of the rolling section from the contact surface due to the rotation of the second actuator with the central axis as the center.

In the displacement detection apparatus of the seventeenth preferred embodiment, since the first impelling section and the second impelling section are both engaged by a common coil spring, there are advantages of a reduced number of components and lower manufacturing costs, while still attaching the second actuator such that rotation is not possible.

In the displacement detection apparatus of the eighteenth preferred embodiment, when the first conducting pattern of the top sheet is pressed onto the second conducting pattern of the base sheet by the rolling section through the intervening spacer sheet, the first conducting pattern and the second conducting pattern are shunted in the position in which contact has been made. In other words, since the electrical resistance changes in conformance with the location that is pressed by the rolling section, which moves in conformance with the movement of the cymbal, there is an advantage that the displacement of the rolling section can be detected by detecting a change in electrical resistance. As a result, it is possible to electrically detect the displacement of the electronic cymbal.

In the displacement detection apparatus of the nineteenth preferred embodiment, in addition to the advantages of the fourteenth embodiment, there is the advantage that it is possible to directly detect the displacement of an electronic cymbal that is structured by a single cymbal.

BRIEF DESCRIPTION OF THE DRAWINGS

FIG. 4(*b*) is an expanded cross-section drawing on the cross-section line A-A shown in FIG. 4(*a*);

DETAILED DESCRIPTION OF PREFERRED EMBODIMENTS

Figure 1:
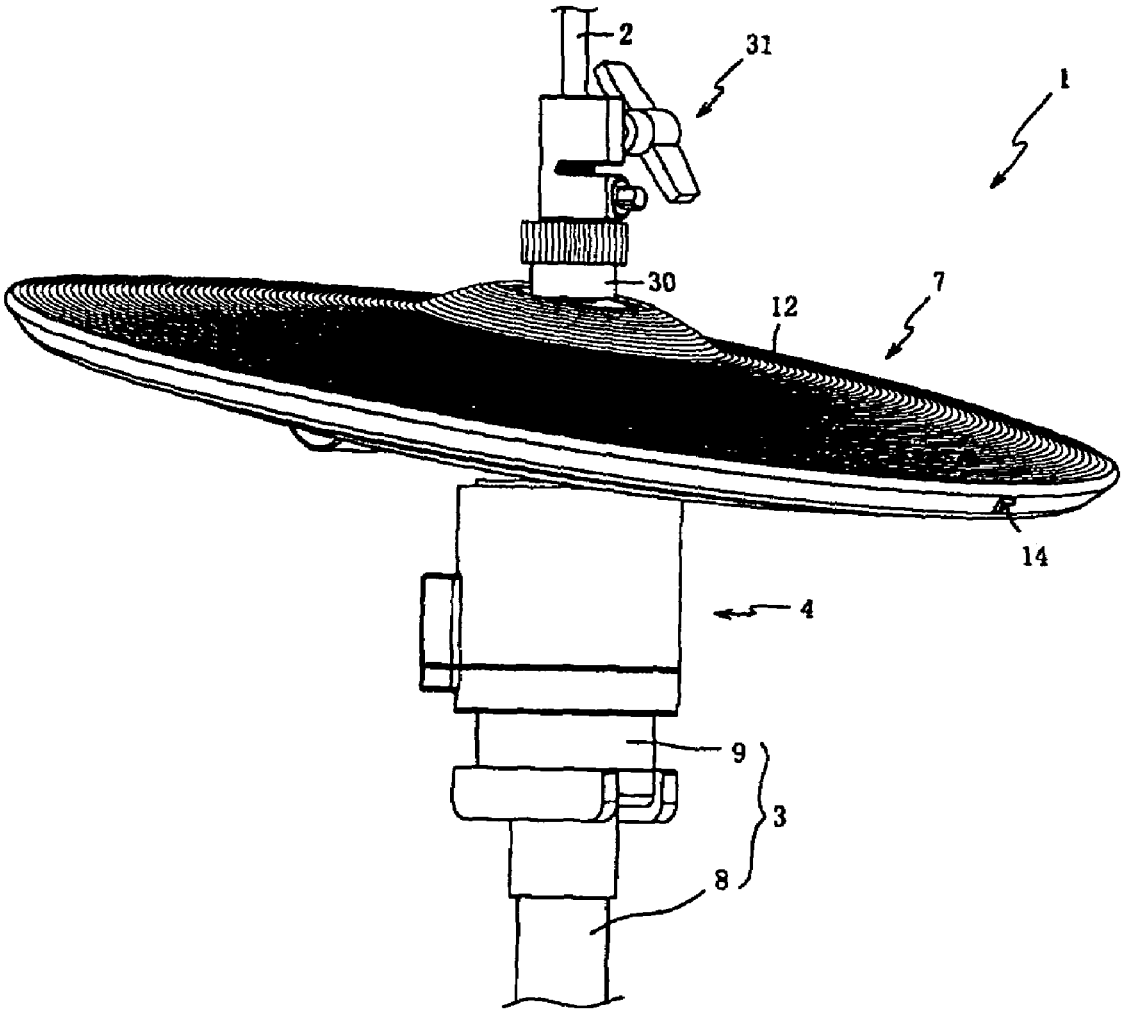
FIG. 1 a is an oblique external view of the electronic high hat cymbal 1, which is the electronic percussion instrument of the present invention.

An explanation will be given below of one preferred embodiment of the present invention while referring to the attached drawings. FIG. 1 is an oblique external view of the electronic high hat cymbal 1, which is one example of the electronic percussion instrument of the present invention. The displacement detection apparatus of the present invention is installed in the electronic high hat cymbal 1. In addition, the state of the cymbal 7 in FIG. 1 is shown after the cymbal 7 has been struck and has become inclined with respect to the shaft 2. The electronic high hat cymbal 1 in FIG. 1 has only one cymbal 7, but still enables a user to simulate the performance feel of an acoustic high hat cymbal configured with two cymbals.

The electronic high hat cymbal 1 is furnished with a stand assembly 3 that comprises a stick-shaped shaft 2 which moves up and down, a cylindrical-shaped case 4 fixed to the stand assembly 3, and a disk-shaped cymbal 7 connected to the shaft 2 above the case 4. The cymbal 7 can swing with respect to the shaft 2. The shaft 2 passes through the case 4 and the stand assembly 3 such that there is play. (The word "play" is used to mean freedom or room for movement.)

The stand assembly 3 is an apparatus attached the case 4 and the cymbal 7 and comprises a shaft 2, a center pipe 8 through which the shaft 2 passes such that there is play, and a base 9 attached to one end of the center pipe 8 that supports the case 4. The stand assembly 3 further comprises a step-on type pedal at the other end of the center pipe 8 which moves the shaft 2 up and down, and a leg section that supports the center pipe 8 in a standing state. The pedal and the leg section are not shown in any of the drawings.

Figure 2:
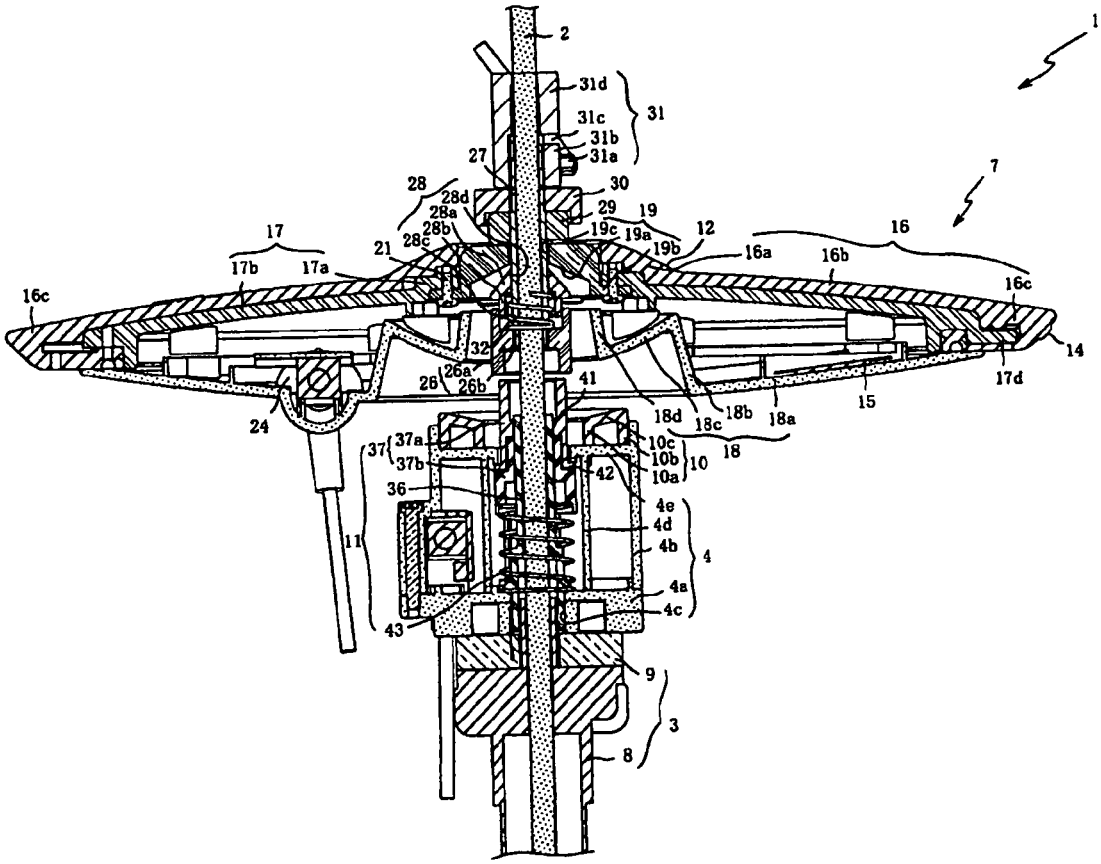
FIG. 2 is a cross-section drawing of the electronic high hat cymbal 1 in an open state.

Referring to FIG. 2, the case 4 forms the pedestal section 10 that fastens the cymbal 7. A displacement sensor 11 is placed inside the pedestal section 10 and the case 4. The displacement sensor is the displacement detection apparatus of the present invention which detects the vertical displacement of the electronic cymbal 7. Details of the pedestal section 10 and the displacement sensor 11 will be discussed later.

The cymbal 7 forms the striking surface 12 that is struck by the performer on its upper surface. The cymbal 7 is attached to the stand assembly 3 so that a mark 14 on the peripheral edge of the cymbal 7 is positioned facing the performer.

The striking surface 12 is formed with an elastic material such as, but not limited to, rubber or elastomer. In addition, irregularities in the form of concentric circles having, for example but not limited to, a flute width of 2 mm, a pitch of 4 mm (the width from flute to flute), and a depth of 1 mm, are formed on the striking surface 12 and coated with a rubber primer (a reactive surface reforming treatment). Other embodiments of the present invention may utilize a combination of different materials, different dimensions, or different coatings.

The design of the striking surface 12 described above enhances the simulation of an acoustic high hat cymbal, while also reduces the amount of abrasion caused by striking it over a long period of time.

In addition, the cymbal 7 moves up and down in conformance with the movement of the shaft 2 in response to the amount that the pedal (not shown in the drawing) is depressed. Pivoting on the shaft 2 at the center, the cymbal can swing after being struck on the striking surface 12. When the pedal is released and the cymbal 7 is completely separated from the pedestal section 10, the cymbal 7 is said to be in an "open state" (See FIG. 2). When the pedal is depressed and the cymbal is seated on the pedestal section 10, the cymbal is said to be in a "closed state" (See FIG. 3).

Figure 3:
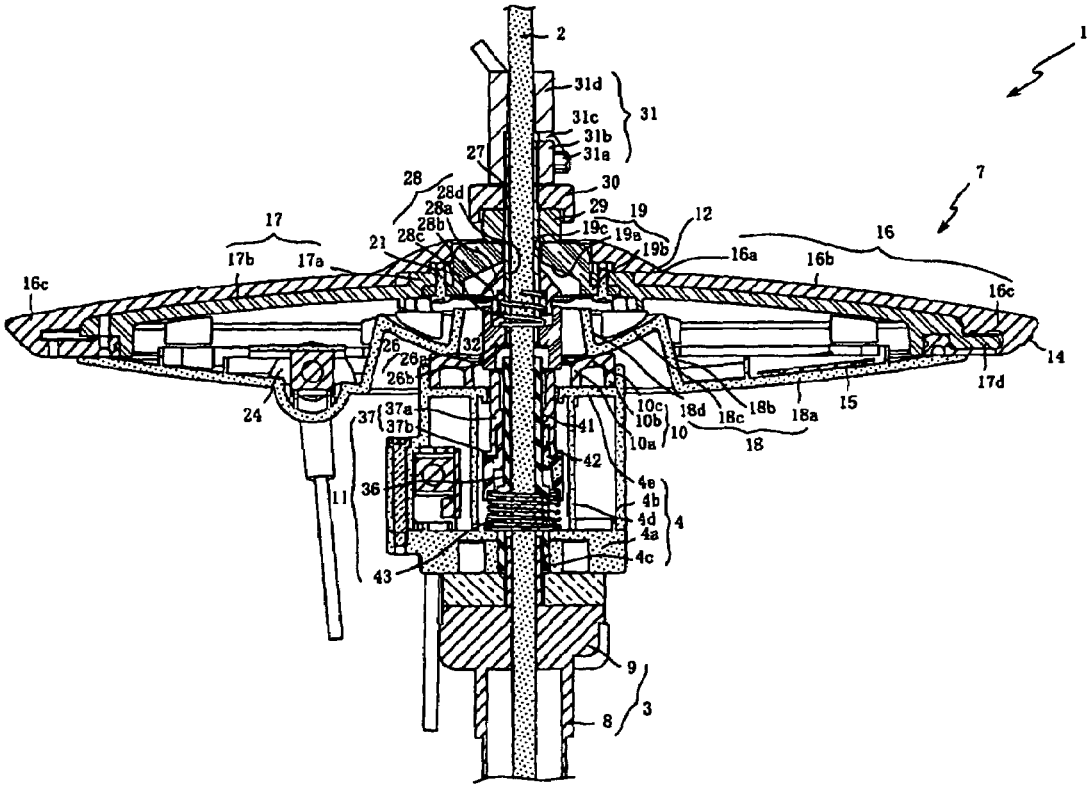
FIG. 3 is a cross-section drawing of the electronic high hat cymbal 1 in a closed state.
Figure 4A:
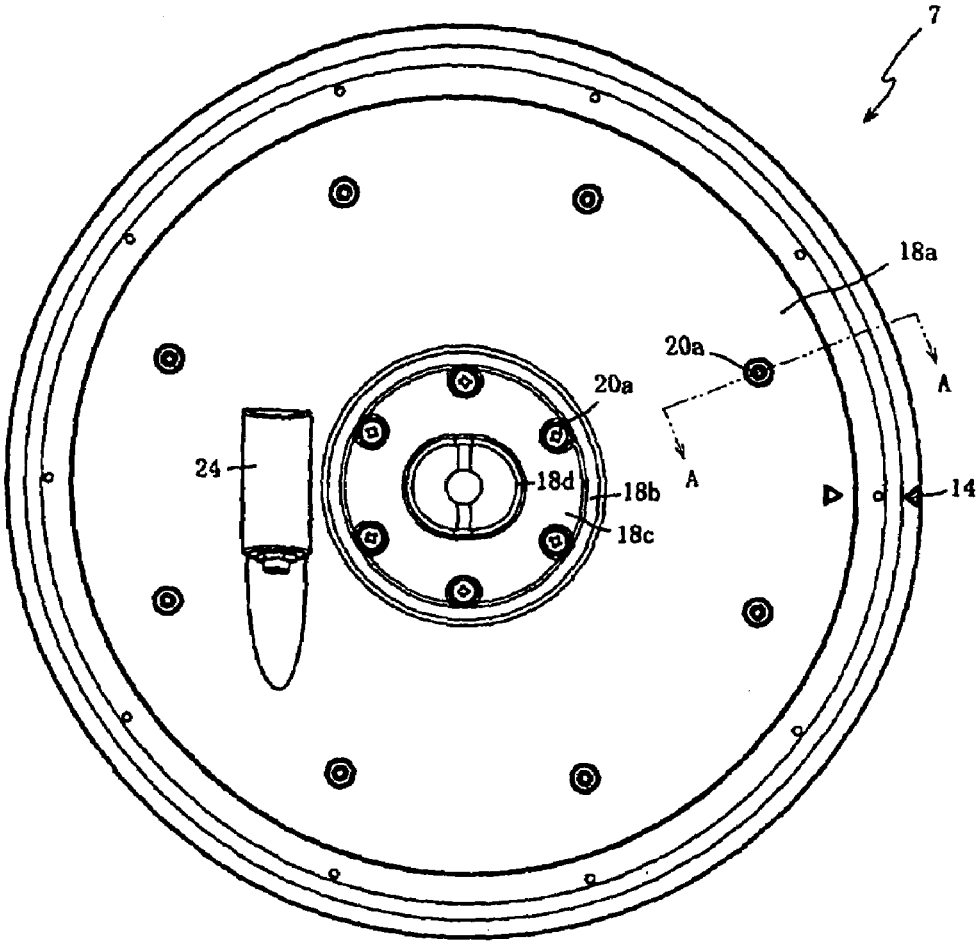
FIG. 4(*a*) is a bottom surface drawing of the cymbal.
Figure 4B:
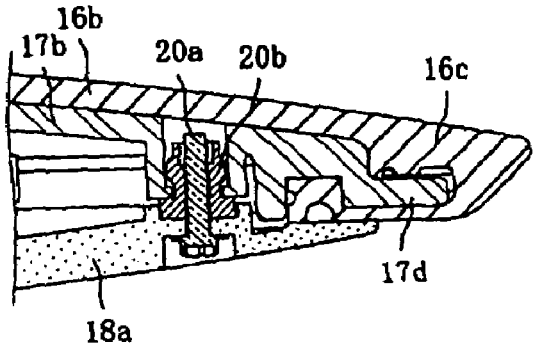

A detailed explanation of the structure of the electronic high hat cymbal 1 will be given below while referring to FIGS. 2-4. FIG. 2 is a cross-section drawing of the electronic high hat cymbal 1 in an open state, while FIG. 3 is a cross-section drawing of the electronic high hat cymbal 1 in a closed state. FIGS. 2 and 3 are both cross-section drawings at the cross-section line that connects the center of the cymbal 7 and the mark 14. FIG. 4(*a*) is drawing of the bottom surface of the cymbal 7, and FIG. 4(*b*) is an expanded cross-section drawing at the cross-section line A-A shown in FIG. 4(*a*). The shaft 2 has been omitted from the drawing in FIG. 4(*a*).

The cymbal 7 is comprised of a cover 16, a first frame 17 that supports the cover 16, and a second frame 18 attached to the first frame 17 so that an inside space is formed between the second frame 18 and the first frame 17. The striking surface 12 is the top surface of the cover 16.

The cover 16 comprises an opening near the center that exposes the head section 19, a cap section 16*a* raised in a dome shape surrounding the opening, an edge section 16*c* that forms the outer edge, and a bow section 16*b* that curves downward in a gentle slope from the cap section 16*a* toward the edge section 16*c*.

The first frame 17 is formed from a hard plastic material such as, but not limited to, acrylonitrile-butadiene-styrene (ABS) resin or polycarbonate resin to support the cover 16. Other embodiments of the present invention may use other materials.

The first frame 17 comprises an opening near the center where the head section 19 is inserted, a shoulder section 17*a* supporting the cap section 16*a* at the periphery of the center opening, and an arm section 17*b* that is a continuation of the shoulder section 17*a* extending toward the outer edge and supporting the bow section 16*b*.

The first frame 17 further comprises an outer peripheral section 17*d* on the mark 14 side (the right side in the drawings) that supports the edge section 16*c*. The outer peripheral section 17*d* is one level lower than the end of the arm section 17*b*, and together the end of the arm section 17*b* and the peripheral section 17*d* form a step shape. The outer peripheral section 17*d* is only formed half way around the first frame 17, with the mark 14 in the middle.

By forming the outer peripheral section 17*d* one level lower than the arm section 17*b*, the thickness of the edge section 16*c* can be made thicker than the bow section 16*b*. The thick edge section 16*c* suppresses vibrations at the edge section 16*c* where the cymbal is struck. Therefore, the vibrations of the cymbal 7 after it is struck is more uniform. In addition, since the edge section 16*c* easily changes shape, this helps in simulating the sensation of striking the edge section 16*c* of the electric cymbal 7 to the sensation of striking the edge section of an acoustic high hat cymbal.

The outer peripheral section 17*d* is not formed on the semicircular portion of the side opposite the mark 14 (the left side in the drawing), and the end section of the arm section 17*b* is covered by the edge section 16*c*.

The head section 19 inserted into the opening near the center of the first frame 17 is formed in a roughly cylindrical shape, and comprises a concave section 19*a* that forms a depression upward from the middle of the bottom surface, a flange section 19*b* that protrudes outward from the bottom side surface, and a cylindrical section 27 that passes through a pass-through hole 19*c* in the center of the head section 19. The flange section 19*b* is attached to the shoulder section 17*a* with screws 21. The cylindrical section 27 will be discussed in more detail later.

Viewed in cross-section, the roof surface of the concave section 19*a* is diagonally sloped from left to right with the pass-through hole 19*c* in the center and the roof surface in contact with the support section 28. The support section 28 is shaped like a mountain viewed in cross section (with a broad base and narrow apex), and will be discussed in more detail later. The cymbal 7 is supported by the support section 28 so that it may swing to the left and to the right. In FIGS. 2 and 3, the cymbal is shown in balance.

The second frame 18 is attached to the first frame 17, forming a space between the second frame 18 and the first frame 17. The second frame 18 comprises a bottom section 18*a* that is gently downward sloping from the outer edge toward the center, a first wall section 18*b* that forms a concave shape from the bottom section 18*a* toward the first frame 17, a seating section 18*c* that curves down from the end of the first wall section 18*b* toward the middle, and a second wall section 18*d* that forms a concave shape from the end of the seating section 18*c* towards the first frame 17.

As shown in FIG. 4(*a*), the second frame 18 is attached to the first frame 17 by screws 20*a* at six locations in the seating section 18*c* and eight locations in the bottom section 18*a*. In addition, the outer peripheral section is linked to the first frame through the cover 16. Other embodiments of the present invention may contain a different number of screws at different locations, or a different method of linking the second frame 18 to the first frame 17.

In this preferred embodiment, the first frame 17 and the second frame 18 are firmly attached so that they are in direct contact (not shown in the drawing) at six locations in the seating section 18*c*. As is shown in FIG. 4(*b*), the first frame 17 and the second frame 18 are also attached at eight locations in the bottom section 18*a* by screws 20*a* via rubber nuts 20*b* that change shape to an anchor form. Since the first frame 17 is firmly attached to the seating section 18*c* near the center of the cymbal, but not firmly attached to the bottom section 18*a* near the edge of the cymbal 7, the second frame 18 will vibrate when the cover 16 is struck. Therefore, it is possible to tune the sensitivity of the vibration sensor on the inner surface of the second frame 18 to uniformly detect the vibrations no matter what portion of the cover 16 is struck. Other preferred embodiments of the present invention may contain a different number of screws, or a different method of attaching the second frame 18 to the first frame 17.

It is possible to link the first frame 17 and the second frame 18 at the outer peripheral area with screws so that they are in direct contact. However, there is a danger that the screws will become loose due to the vibrations. Therefore, by linking the first frame 17 and the second frame 18 via the rubber nuts 20*b* described in the present preferred embodiment, the possibility of loosening of the screws 20*a* is reduced because the vibration is absorbed by the rubber nuts 20*b*.

A vibration sensor 15 and a jack 24 are placed inside the space formed and surrounded by the second frame 18 and the first frame 17. The vibration sensor 15 detects the vibrations from the striking surface 12. The jack 24 is connected to the vibration sensor 15 by a wiring and outputs the vibrations detected by the vibration sensor as an electrical signal via another wiring.

In this embodiment of the present invention, the vibration sensor 15 is placed on the inner surface of the bottom section 18*a* on the second frame 18. Hence, there is a space separating the vibration sensor 15 and the first frame 17. Therefore, in this embodiment, the vibration transmitted to the vibration sensor 15 and the detection sensitivity of the vibrations are more uniform compared to the case in which the vibration sensor 15 is located on the inner surface of the first frame 17.

In addition, the vibration sensor 15 is placed roughly in the center area on the inner surface of the bottom section 18*a*. Therefore, the vibration sensor 15 is located suitably spaced from the shaft 2. Hence the vibrations transmitted from the shaft 2 are dulled, and the sensitivity towards detecting the vibrations from the striking surface 12 is enhanced.

Figure 5:
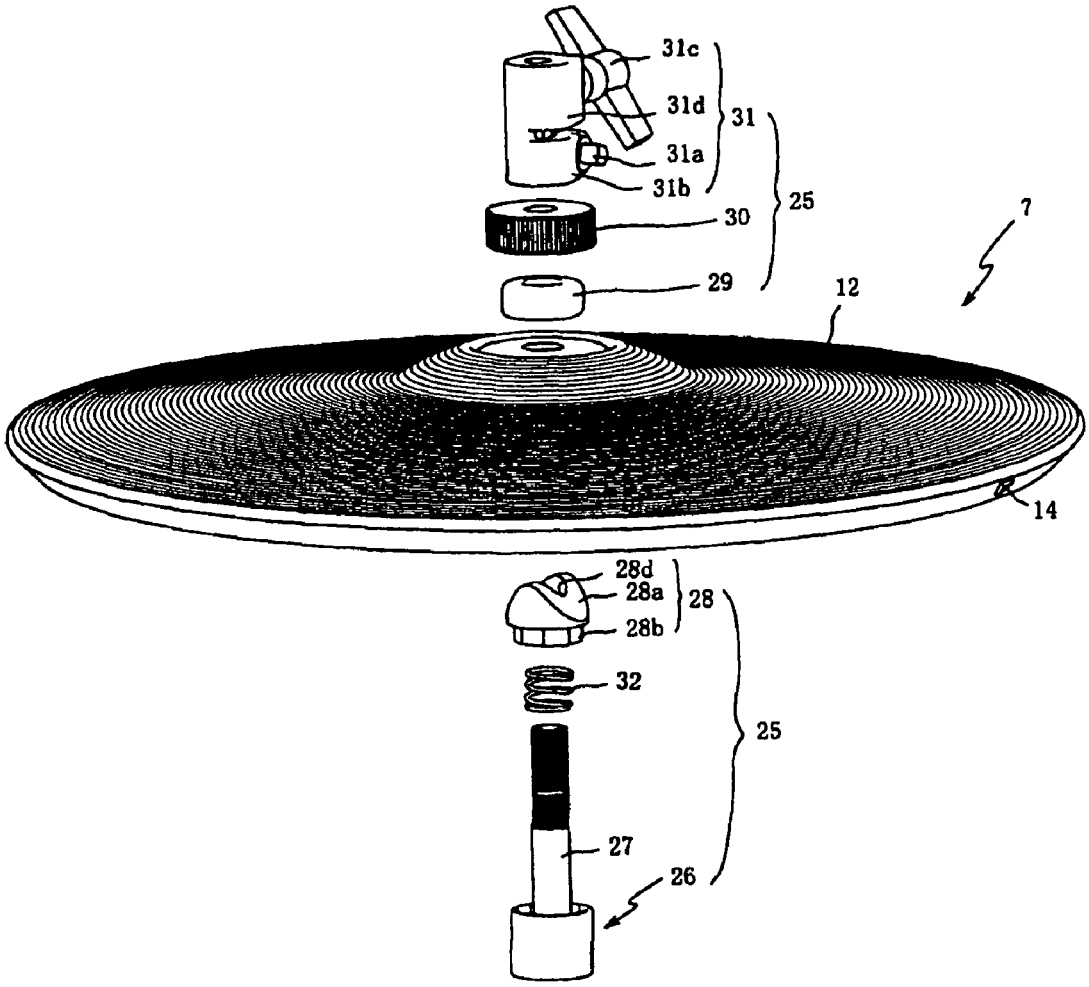
FIG. 5 is an exploded oblique view drawing of the support mechanism that supports the cymbal.

Next, an explanation will be given of the support mechanism 25 that supports the cymbal 7 using FIG. 5 in conjunction with FIGS. 2-4. FIG. 5 is an exploded oblique view of the support mechanism that supports the cymbal 7. The stand assembly 3 also includes the shaft 2, which has been omitted from the drawing in FIG. 5 in order to make the understanding of the drawing easier.

As is shown in FIG. 5, the support mechanism 25 comprises: a rotation control section 26; a cylindrical section 27 that extends from the rotation control section 26; a support section 28 through which the cylindrical section 27 passes such that there is play; a rubber washer 29 that the cylindrical section 27 passes through such that there is play; an adjusting nut 30 that screws onto the cylindrical section 27 from above the rubber washer 29; and, a clutch 31 above the adjusting nut 30 that anchors the cylindrical section 27 with the shaft 2. The cymbal 7 is held between the rubber washer 29 and the support section 28.

The rotation control section 26 is mated with the lower portion of the support section 28 and restricts the rotation of the support section 28 with the shaft 2 at the center. The rotation section 26 comes into contact with the upper actuator 37*a*. The rotation control section 26 is formed roughly in the shape of a hollow pipe and comprises of a partitioning wall 26*a* that partitions the inside vertically and a linking hole 26*b* that is opened in the partitioning wall 26*a*. (Refer to FIGS. 2 and 3.) The linking hole 26*b* links the rotation control section to one end of the cylindrical section 27. The inner surface above the partitioning wall 26*a* is formed in a polygonal shape in a planar view so as to mate with the lower portion of the support section 28.

The cylindrical section 27 has a hollow pipe shape that forms a path through which the shaft 2 passes so that there is play. One end of the cylindrical section 27 is linked to the linking hole 26*b* of the rotation control section 26 and the other end has a male thread on its outer peripheral surface.

The support section 28 is placed in contact with the concave section 19*a* of the head section 19 and supports the cymbal 7 so that the cymbal 7 may swing with respect to the shaft 2. The support section 28 comprises a mountain-shaped (broad base and narrow apex) peaked section 28*a* that is in contact with the roof surface of the concave section 19*a* sloping at an angle sharper than that of the roof surface of the concave section 19*a*, a mating section 28*b* that is attached to the bottom of the peaked section 28*a*, a concave section 28*c* (refer to FIG. 2 and FIG. 3) that is depressed upward from the bottom of the mating section 28*b*, and a pass-through path 28*d* through which the cylindrical section 27 is passed.

The support section 28 is attached to the cylindrical section 27 with the cylindrical section 27 passing through the pass-through path 28*d* such that there is play. One end of the coil spring 32 is in contact with the concave section 28*c* of the support section 28 in a state in which the cylindrical section 27 passes through the coil spring 32 such that there is play. In addition, the outer surface of the mating section 28*b* is formed in a polygonal shape in a planar view so as to mate with the inner surface of the rotation control section 26 that is also formed in a polygonal shape in a planar view, thus restricting the rotation of the support section 28 with respect to the cylindrical section 27. Furthermore, when the apex of the peaked section 28*a* is in contact with the roof surface of the concave section 18*a*, the cymbal 7 is supported by the support section 28 such that swinging is possible only in the left-right direction of FIGS. 2 and 3.

The adjusting nut 30 is screwed onto the male thread of the cylindrical section 27 and can be used to adjust the position of the rotation control section 26 relative to the cymbal 7 and the actuator 37 in the vertical direction. The operation of the adjusting nut 30 will be discussed later while referring to FIG. 8, and the actuator 37 will also be discussed later in more details.

The clutch 31 comprises a clutch bolt 31*a*, a hollow pipe-shaped first anchoring section 31*b* through which the cylindrical section 27 passes, a wing bolt 31*c*, and a hollow pipe-shaped second anchoring section 31*d* that connects to the upper portion of the first anchoring section 31*b*. The shaft 2 passes though the second anchoring section 31*d*.

When the clutch bolt 31*a* of the clutch 31 is tightened with the cylindrical section 27 passing through the first anchoring section 31*b* and the shaft 2 passing through the second anchoring section 31*d*, the first anchoring section 31*b* presses on and anchors the cylindrical section 27. The shaft 2 can be anchored by the tightening of the wing bolt 31*c*.

Using the support mechanism 25 discussed above, the cymbal 7 is attached to the support mechanism 25 so that it cannot rotate with the shaft 2 at the center but can swing with the shaft 2 at the center.

Figure 6:
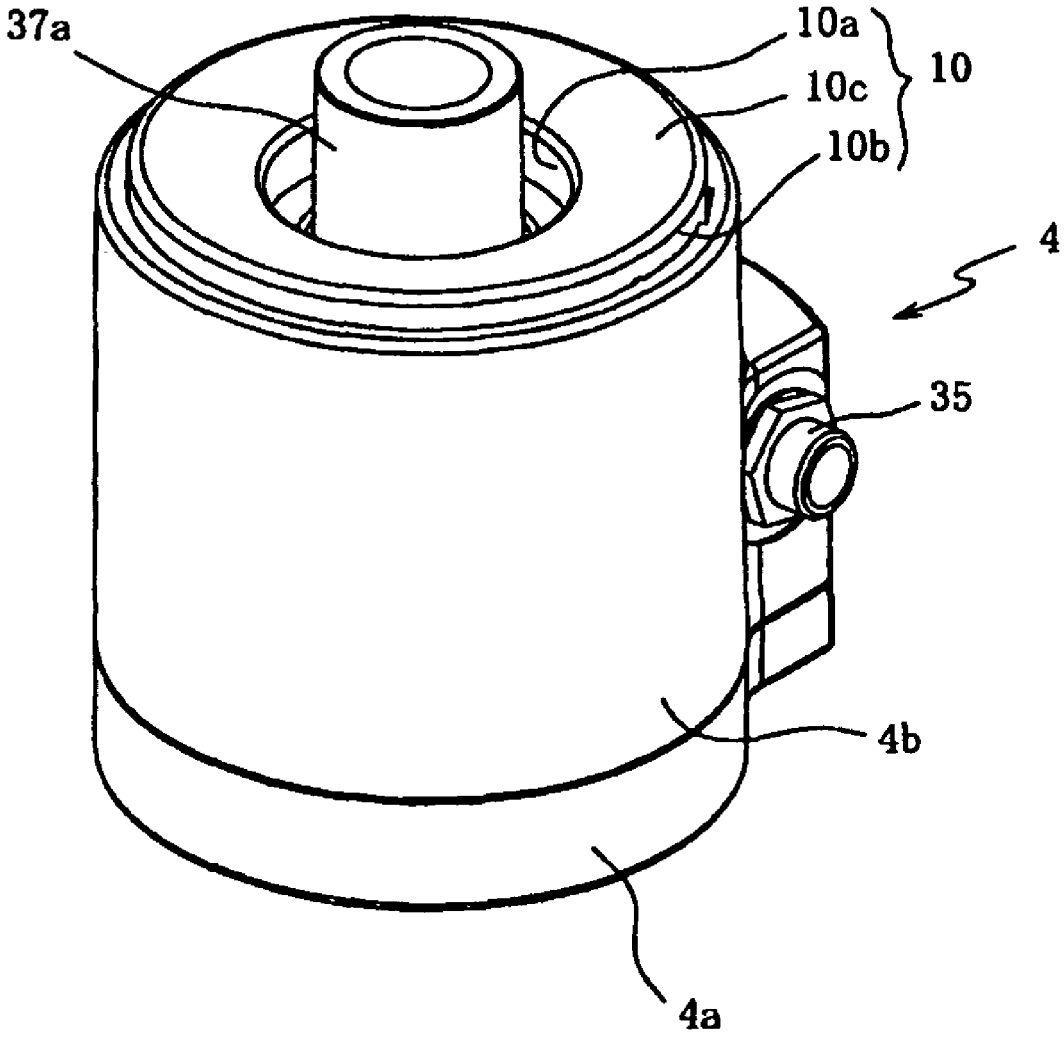
FIG. 6 is an exterior oblique view drawing of the case.

Next, FIG. 6 will be used in conjunction with FIGS. 2-4 to explain the case 4. FIG. 6 is an exterior oblique view drawing of the case 4. The case 4 comprises a base 4*a*, a side wall 4*b* that extends upward from the peripheral edge of the base 4*a*, a pass-through hole 4*c* (refer to FIG. 2) that passes through the base 4*a*, an inner wall 4*d* (refer to FIG. 2) surrounding the pass-through hole 4*c* that extends in a cylindrical shape upward from the base 4*a*, and a roof wall 4*e* (refer to FIG. 2) that connects the upper edge of the inside wall 4*d* to the inside surface of the side wall 4*b*.

In addition, a displacement sensor 11 is housed in the space between the inner wall 4*d* (refer to FIG. 2) and a jack 35 (refer to FIG. 6). The detection results of the displacement sensor 11 are output as an electrical signal via a wiring (not shown) on the outer peripheral surface of the side wall 4*b*. Details of the displacement sensor 11 will be discussed later.

Furthermore, the pedestal section 10 is in the area surrounded by the upper surface of the roof wall 4*e* and the side wall 4*b*, with the side wall 4*b* extending higher than the roof wall 4*e*. The pedestal section 10 is formed from an elastic material such as, but not limited to, rubber. The pedestal section 10 comprises an inner wall 10*a* that forms a pass-through hole in the center through which the actuator 37 passes, an outer wall 10*b* that extends higher than the upper edge section of the side wall 4*b* of the case 4, and a sloping wall 10*c* that slopes downward from the upper edge of the outer wall 10*b* toward the inner wall 10*a*.

Figure 7A:
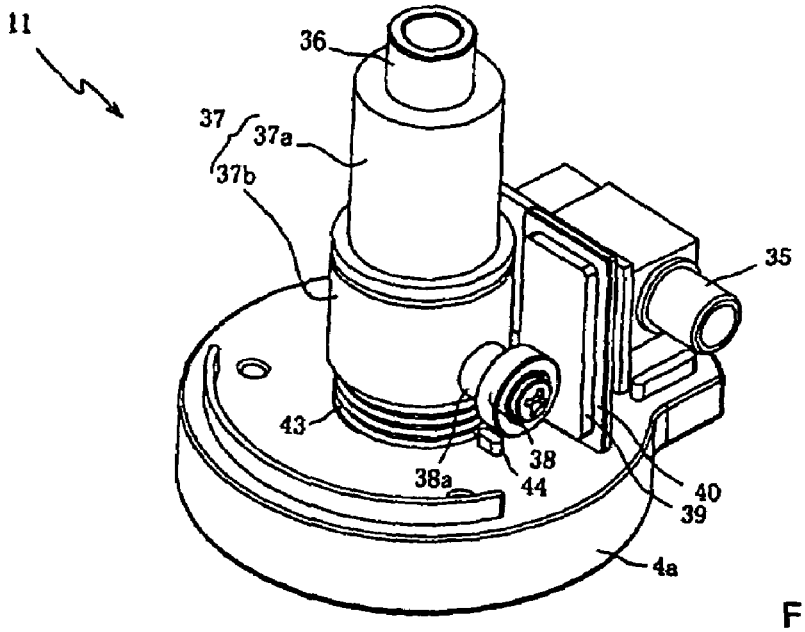
FIG. 7 is an oblique view drawing that shows the displacement sensor.
Figure 7B:
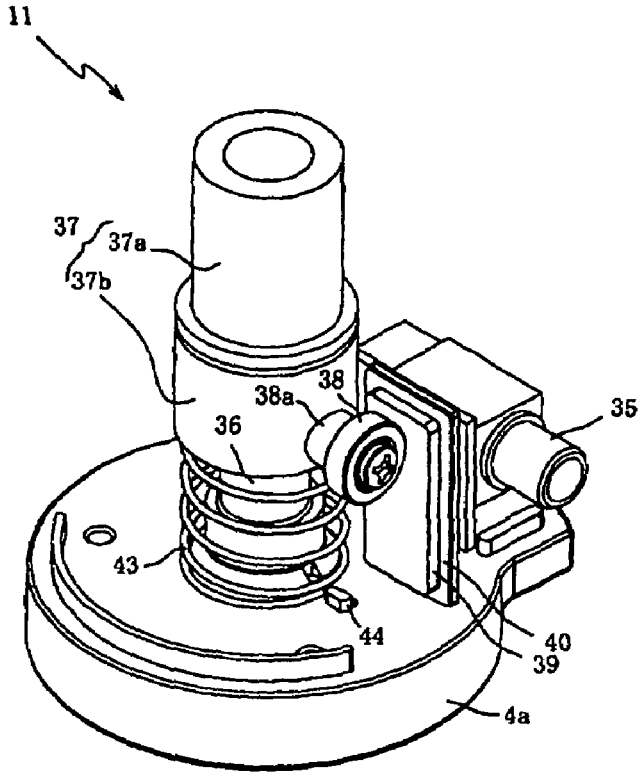
Figure 8B:
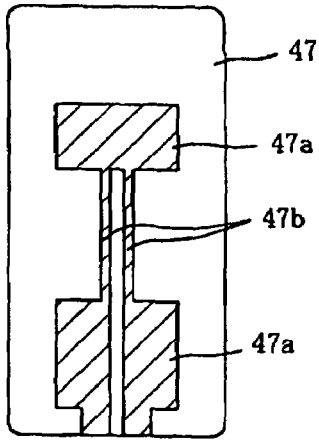
FIG. 8 is a drawing for the explanation of the configuration of the sheet sensor.
Figure 8B:
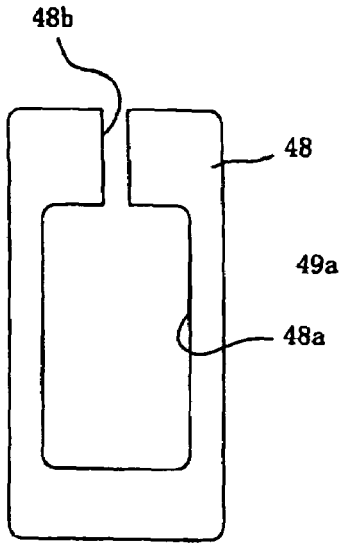
Figure 8B:
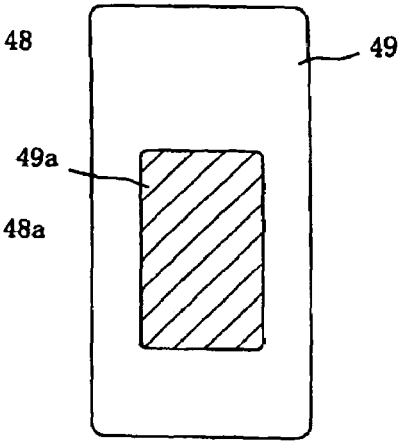
Figure 8B:
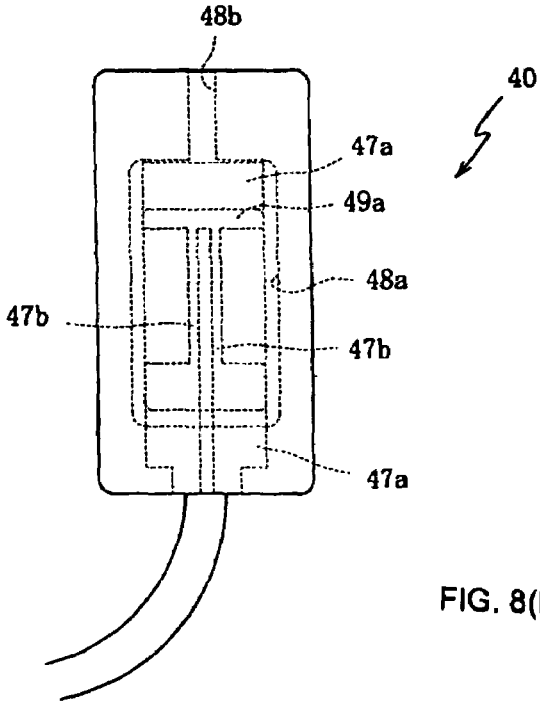

Next, FIGS. 7 and 8 will be used in conjunction with FIGS. 2-4 to explain the displacement sensor 11 that is housed in the case 4. FIG. 7 is an oblique view drawing that shows the displacement sensor 11. FIG. 7(*a*) shows the state of the displacement sensor 11 when the cymbal 7 is closed, and FIG. 7(*b*) shows the state of the displacement sensor 11 when the cymbal 7 is open. FIG. 8 shows the configuration of the sheet sensor 40.

The displacement sensor 11 comprises a hollow pipe-shaped sleeve 36 that is inserted in the pass-through hole 4*c* and extends upward, a hollow pipe-shaped actuator 37 that the sleeve 36 passes through such that there is play, a bearing 38 attached to the actuator 37 such that rolling is possible, a sheet sensor cushion 39 that is in contact with the rolling surface of the bearing 38, and a sheet sensor 40 that is aligned and affixed to the back of the sheet sensor cushion 39.

The shaft 2 passes through the inside of the sleeve 36 such that there is play. The outer surface of the sleeve 36 passes through the actuator 37 such that there is play. The sleeve 36 extends above the base 4*a* to a position lower than the upper surface of the pedestal section 10.

The actuator 37 comprises a hollow pipe-shaped upper actuator 37*a* which is in contact with one end of the rotation control section 26, and a hollow pipe-shaped lower actuator 37*b* that supports the upper actuator 37*a* from below.

As is shown in FIG. 2, the outside diameter of the upper portion of the lower actuator 37*b* is smaller than the inside diameter of the upper actuator 37*a*, and the upper portion of the lower actuator 37*b* is inserted into the upper actuator 37*a* up to where the protrusion 41 of the inner surface of the upper actuator 37*a*. The upper actuator 37*a* is supported by the lower actuator 37*b* at the area of the protrusion 41.

Therefore, the contact area between the lower actuator 37*b* and the upper actuator 37*a* is limited to a small area. Accordingly, with the upper actuator 37*a* in contact with the rotation control section 26, even if the cymbal 7 rotates with the shaft 2 as the center and the rotational force has been transmitted to the upper actuator 37*a* through the rotation control section 26, the rotational force is less likely to be transmitted to the lower actuator 37*b* and more likely to be absorbed by the upper actuator 37*a*.

The lower portion of the lower actuator 37*b* has an expanded diameter compared to the upper portion. The flange 42 has an outside diameter roughly the same as that of the lower portion of the lower actuator 37*b* with the expanded diameter, and is placed at the end of the upper actuator 37*a*. Furthermore, a hole that has a smaller diameter than the flange 42 and a larger diameter than the cylindrical portion of the upper actuator 37*a* is located at the roof wall 4*e* of the case 4. Since the cylindrical portion of the upper actuator 37*a* is passed through this hole so that there is play, the actuator 37 is prevented from jumping out of the inside space surrounded by the inner wall 4*d* of the case 4.

In this manner, the upper actuator 37*a* is supported by the lower actuator 37*b* so that the upper actuator is free to rotate with the sleeve 36 as the center. In addition, the coil spring 43 is placed between the lower actuator 37*b* and the base 4 with the sleeve 36 passing through the coil spring 43 so that there is play. Therefore, when the cymbal 7 moves downward and the rotation control section 26 comes into contact with the upper actuator 37*a*, and the actuator 37 resists the impelling force of the coil spring 43 in conformance with the movement and is moved downward. When the cymbal 7 moves upward, the actuator moves upward due to the repulsive force of the coil spring 43.

In addition, the coil spring 43 is attached in a twisted state with one end stopped by a protrusion 44 (refer to FIG. 7) that protrudes from the upper surface of the base 4*a* and the other end stopped by the lower actuator 37*b* such that the bearing 38 presses on the sheet sensor cushion 39.

The bearing 38 rolls against the sheet sensor cushion 39 in conformance with the up and down movement of the actuator 37. The bearing 38 is anchored by the support shaft 38*a* that extends in the horizontal direction from the outer surface of the lower actuator 37*b* so that it may roll freely.

By attaching the bearing 38 to the lower actuator 37*b* in this manner, compared to a case in which the bearing is attached to the upper actuator 37*a* which can rotate with the sleeve 36 as the center, the bearing 38 is prevented from detaching from the sheet sensor cushion 39 because the lower actuator cannot rotate. In addition, by arranging the coil spring 43 in a twisted state as described above such that the bearing 38 presses on the sheet sensor cushion 39, the detachment of the bearing 38 from the sheet sensor cushion 39 can thus be prevented.

The sheet sensor cushion 39 has a contact surface that the bearing 38 rolls on and is placed with the length of the broad surface along the direction of movement of the actuator 37. The sheet sensor cushion 39 is constructed from an elastic body such as, but not limited to, sponge. Because of this, the sheet sensor cushion 39 is spread by the force from the bearing 38 and hence can certainly produce a shunting on the sheet sensor 40.

The sheet sensor 40 is adhered to the back surface of the sheet sensor cushion 39 and is a sensor that detects the vertical displacement of the cymbal 7 by detecting the position of the bearing 38.

The sheet sensor 40 is structured by bonding together of a base film 47 shown in FIG. 8(*a*-1), a spacer film 48 shown in FIG. 8(*a*-2), and a top film shown in FIG. 8(*a*-3). All of these films are formed from resin thin films with insulating properties or thin films of other suitable materials.

On one surface of the base film 47, two conductive printed sections 47*a* are formed in a specified pattern as two blocks with a spacing between them, and two band-shaped carbon printed sections 47*b* are formed to connect the conductive printed sections 47*a*. The spacer film 48 comprises of a first opening section 48*a* that is opened in the middle, and a second opening section 48*b* that is opened in a band shape from the first opening section 48*a* to the edge of the film. The conductive printed section 49*a* is formed in a specified pattern roughly in the middle of one surface of the top film 49.

As shown in FIG. 8(*b*), the spacer film 48 is held between one surface of the base film 47 and one surface of the top film 49 such that the conductive printed section 49*a* printed on the top film 49 and the carbon printed section 47*b* of the base film 47 face each other with the first opening section 48*a* of the spacer film 48 between them. The films are bonded such that the other surface of the top film 49 is affixed to the back of the sheet sensor 39.

By this means, when the bearing 38 presses on the sheet sensor 39, the conductive printed section 49*a* of the top film 49 is pressed by the carbon printed section 47*b* of the base film 47 through the first opening area 48*a* of the spacer film 48. When this happens, the area between the two carbon printed sections 47*b* is shunted by the conductive printed section 49*a* at the location that has been pressed.

In other words, when the actuator 37 is pushed downward in conformance with the movement of the cymbal 7 or when the actuator 37 is pushed upward by the coil spring 43, the bearing 38 rolls up and down on the sheet sensor cushion 39 in conformance with the up and down movement of the actuator 37. The resistance value of the sheet sensor 40 changes with the up and down movement of the bearing 38, hence the vertical displacement of the bearing 38 can be detected by a change in the resistance value. As a result, the vertical displacement of the cymbal 7 can be measured through the change in resistance value.

By forming the second opening section 48*b* in the spacer film 48, when the top film 49 is pushed onto the base film 47 by the bearing 38, the air that exists in the first opening section 48*a* can be pressed out through the second opening section 48*b*.

Figure 9A:
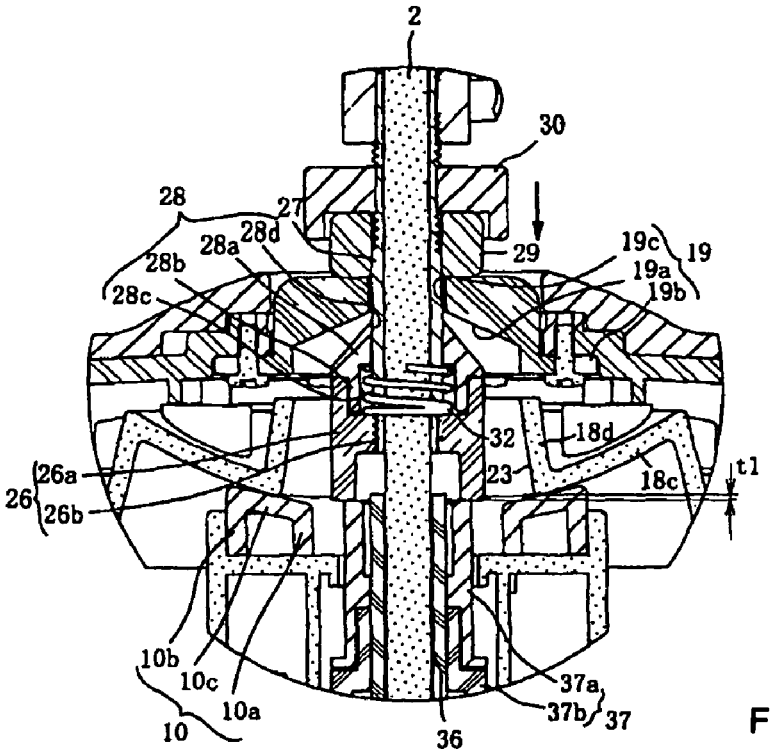
FIG. 9 is an enlarged drawing of the area around the support section in the closed state.
Figure 9B:
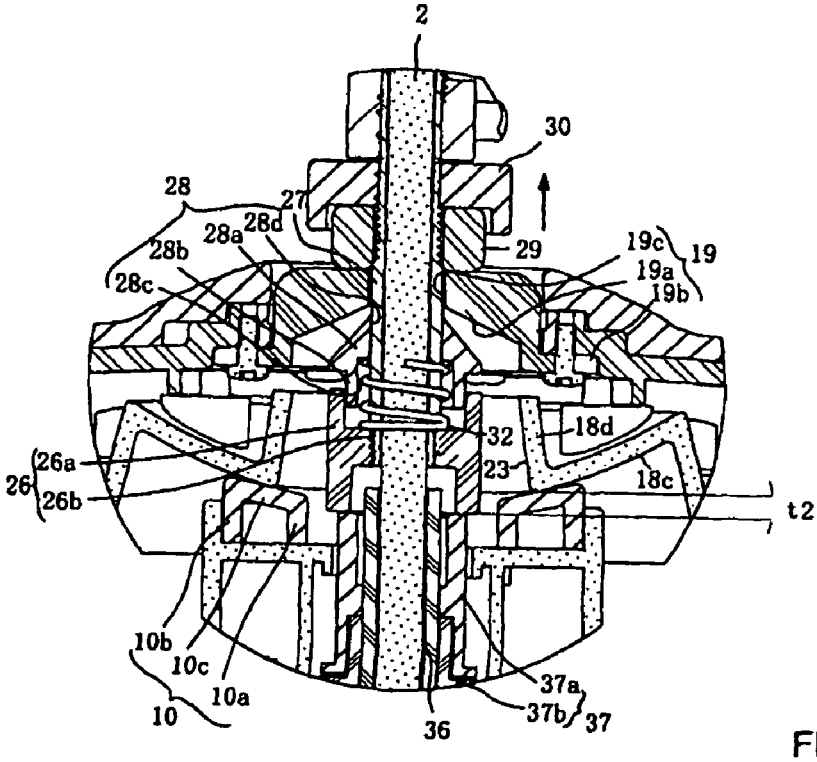

Next, using FIG. 9, an explanation will be given regarding the adjustment method for making adjustments such that a specified resistance value is detected by the sheet sensor 40 in the closed state. FIG. 9 is an enlarged drawing of the area around the support section 28 in the closed state.

Normally, the configuration is such that the sheet sensor 40 detects a specified resistance value (hereinafter referred to as the "specified value") in the closed state. When that specified value is detected, an electric signal that corresponds to the specified value is output.

However, due to factors such as variations in the component performance of the coil spring 43 and of the electrical contacts of the sheet sensor 40, there is a variation in the detected specified value that indicate the closed state for each product. Therefore, by performing the following operation, it is possible to mechanically eliminate the disparities.

For example, as is shown in FIG. 9(*a*), when the adjusting nut 30 that is screwed onto the cylindrical section 27 is screwed downwards towards the cymbal 7, the rotation control section 26 that connects to the other end of the cylindrical section 27 is pushed upward with the resistance of the coil spring 32. That is to say, since the cylindrical section 27 passes though the cymbal 7 and the support section 28 so that there is play, and that the actuator 37 is separated from the cylindrical section 27, it is possible to move the rotation control section 26 upward relative to the cymbal 7, the support section 28, and the actuator 37. Therefore, the amount t1 that the actuator 37 is pushed in the closed state is small. Accordingly, it is possible to detect a closed state at the point in time that there has been a pressing by the bearing 38 higher than the initial position.

On the other hand, as is shown in FIG. 9(*b*), when the adjusting nut 30 is moved upwards away from the cymbal 7, the rotation control section 26 is pushed downward by the coil spring 32. That is to say, in the same manner as discussed above, it is possible for the rotation control section 26 to be moved downward relative to the cymbal 7, the support section 28, and the actuator 37. Therefore, the amount t2 that the actuator is pushed in an open state is large. Accordingly, it is possible to detect a closed state at the point in time that there has been a pressing by the bearing 38 lower than the initial position.

In this manner, it is possible to calibrate for the variances of the specified values that indicate a closed state for each product simply by adjusting the adjusting nut 30. Incidentally, since the adjusting nut 30 is above the cymbal 7 at this time, such an operation is simple.

Figures 10A, 10B:
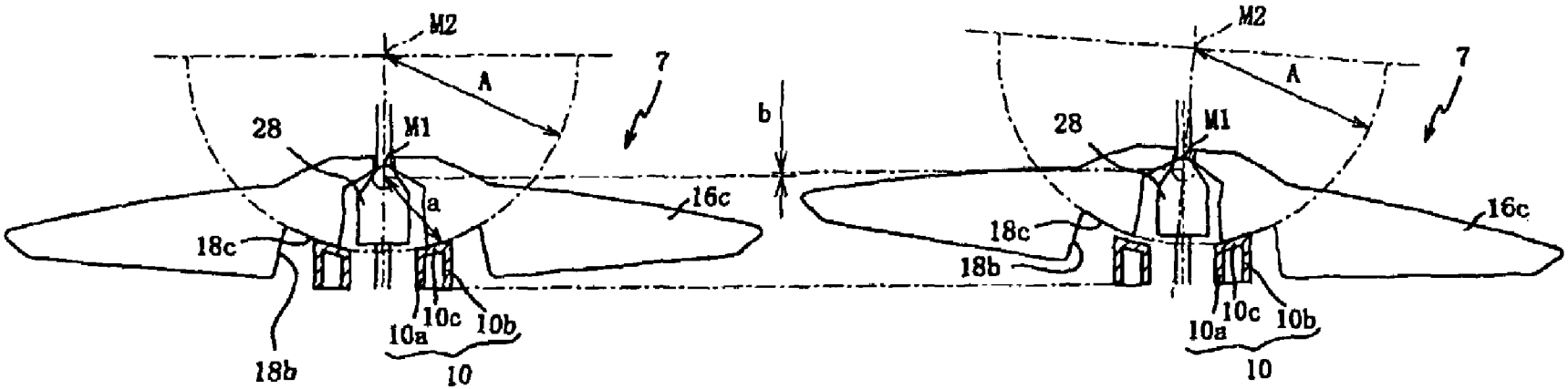
FIG. 10 is a drawing that shows schematically the relationship between the cymbal, the support section, and the pedestal.

Next, referring to FIG. 10, an explanation will given regarding the action of the cymbal 7 in those cases where the cymbal 7 is struck in a closed state and in those cases where the cymbal 7 is brought to a closed state while it is in the midst of swinging. FIG. 10 is a drawing that shows schematically the relationship between the cymbal 7, the support section 28, and the pedestal section 10.

As discussed above, the seating section 18*c* is formed curving downward from the edge of the first wall section 18*b* toward the middle section. More specifically, the seating section 18*c* is structured curving downward with a radius of curvature A (center, M2) that is greater than the radius of curvature a of the support section 28. Therefore, the cymbal 7 can swing to the left and to the right of the drawing, while being supported by the support section 28 at the center M1.

On the other hand, the sloping wall 10*c* of the pedestal section 10 on which the seating section 18*c* sits is formed depressed in the direction of the curve of the seating section 18*c* such that the outer shape roughly approximates that of the seating section 18*c*. Specifically, a structure with a slope that drops toward the middle section in the straight line direction of the radius of curvature A of roughly the same slope as the seating section 18*c* is preferable. In particular, in this preferred embodiment, the structure has a slope that drops toward the middle section in the straight line direction of the radius of curvature of roughly the same slope as the seating section 18*c* at the seating point of the seating section 18*c* in the closed state.

When the edge section 16*c* of the cymbal 7 that is in the closed state shown in FIG. 10(*a*) is struck, as is shown in FIG. 10(*b*), the shaft 2 is raised only the extent of the dimension b by the cymbal 7. Here, in the case of the closed state when the pedal is stepped on, even raising the shaft merely the extent of the dimension b is extremely difficult.

Therefore, for example, with the slope angle of the sloping wall 10*c* made the same as in this preferred embodiment, in those cases where the radius of curvature of the seating section 18*c* has been made roughly the same as the radius of curvature a, because the change in the direction of the height for the seating section 18*c* is small, the seating section 18*c* does not separate from the sloping wall 10*c*. Hence, there is a danger that the seating section 18*c* will become immobilized on the sloping wall 10*c* in an inclined state.

On the other hand, with the angle of curvature of the seating section 18*c* made the same as in this preferred embodiment, in those cases where the slope angle of the sloping wall 10*c* is made larger or smaller than the angle of this preferred embodiment, there is a danger that the seating section will be brought to a horizontal state at once or be immobilized in a slanted state.

For those reasons, by forming the shapes of the seating section 18*c* and the sloping wall 10*c* in accordance with this preferred embodiment, in those cases where the cymbal 7 is struck in a closed state and in those cases where the cymbal 7 is brought to a closed state while it is in the midst of swinging, the cymbal gradually becomes horizontal while swinging to the right and to the left. Hence it is possible to simulate the performance feel of an acoustic high hat cymbal even with a single cymbal.

Figure 11B:
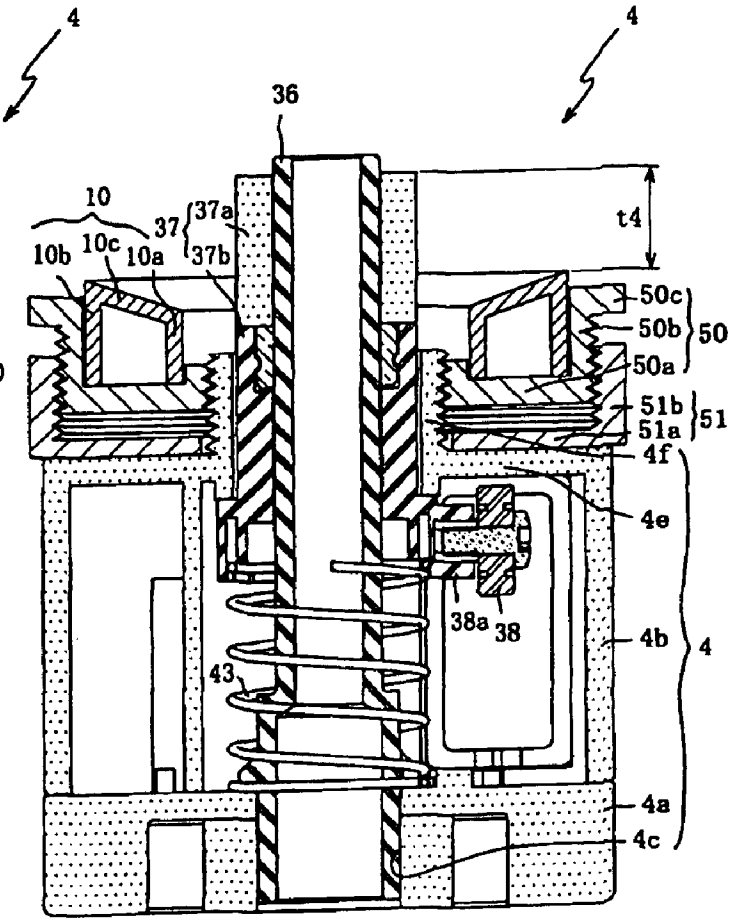
FIG. 11 is an enlarged cross-section drawing of the case that is installed in the electronic high hat cymbal 100 in another preferred embodiment.
Figure 11A:
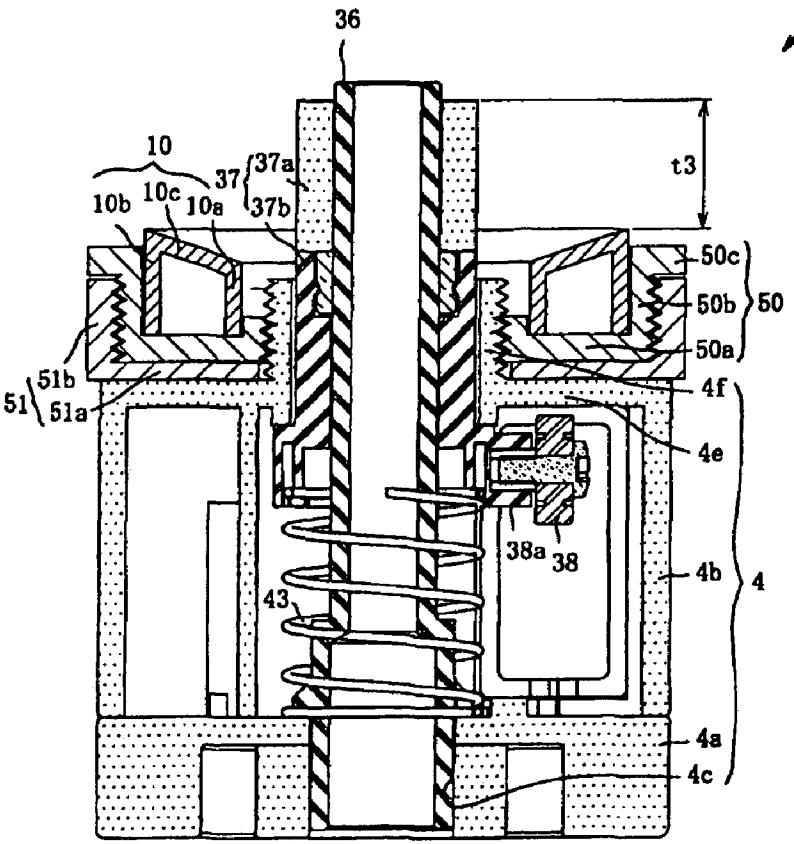
Figure 12:
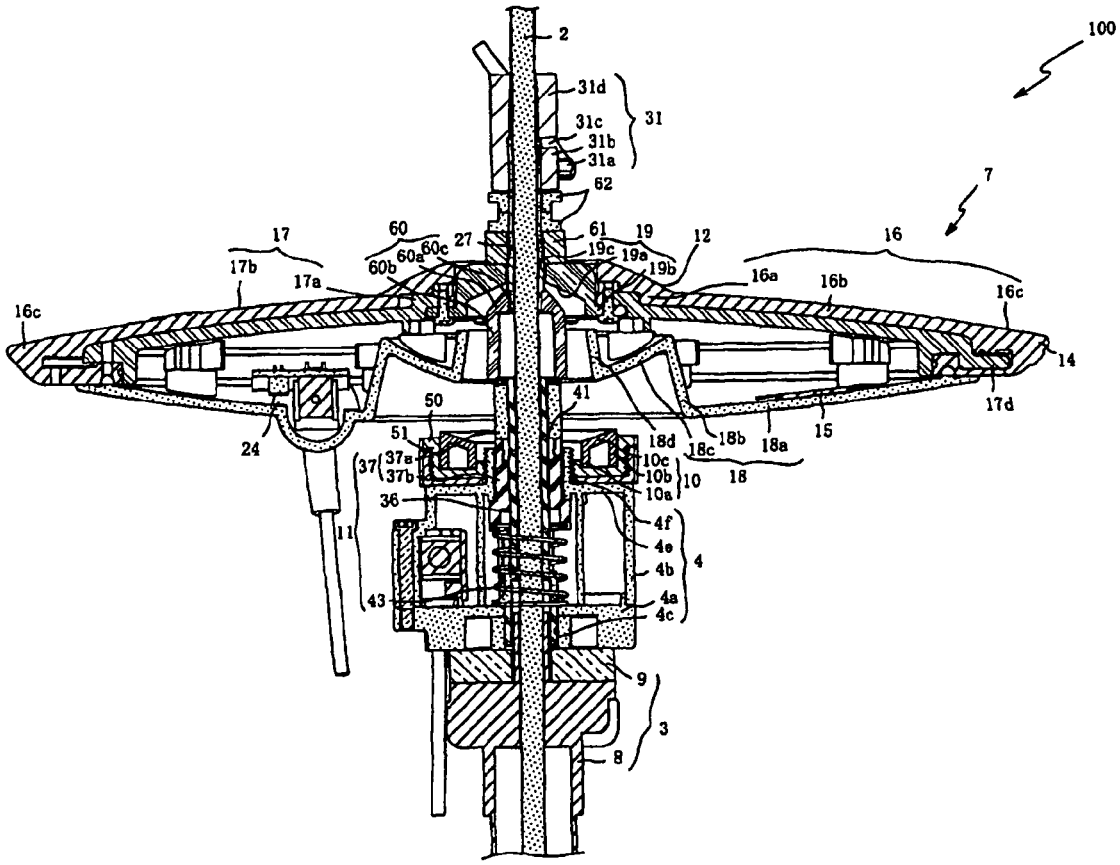
FIG. 12 is a cross-section drawing of the electronic high hat cymbal 100 in the same preferred embodiment as in FIG. 11.

Next, referring to FIGS. 11 and 12, an explanation will be given regarding the electronic high hat cymbal 100 of another preferred embodiment with which the adjusting mechanism is installed so that the calibration of the detected specified value by the sheet sensor 40 in a closed state uses a different method as described above. FIG. 11 is an enlarged cross-section drawing of the case 4 that is installed in the electronic high hat cymbal 100 of the second preferred embodiment. FIG. 12 is similar to FIG. 2 and shows a cross-section of the electronic high hat cymbal 100 of the current preferred embodiment. The explanations of the structures that are common to those of the previous and current preferred embodiments with identical keys have been omitted.

The adjusting mechanism installed in the electronic high hat cymbal 100 of the current preferred embodiment is one with which the adjustments are made by moving the pedestal 10 up and down relative to the cymbal 7 and the actuator 37, in order to detect the specified value of the sheet sensor 40 in the closed state.

Specifically, the adjusting mechanism that is installed in the electronic high hat cymbal 100 of this preferred embodiment comprises a pedestal holder 50 that supports the pedestal section 10 and a pedestal holder anchoring wall 4*f* connected to the roof wall 4*e* of the case 4. The pedestal holder anchoring wall 4*f* extends upward in a cylindrical shape and the actuator 37 passes through it such that there is play.

The pedestal holder 50 comprises a bottom wall 50*a* with an opening in the center that is screwed onto the outer surface of the pedestal holder anchoring wall 4*f*, a side wall 50*b* that is placed standing upward from the peripheral edge of the bottom wall 50*a* surrounding the pedestal section 10, and a flange 50*c* that protrudes outward from the upper edge section of the side wall 50*b*. The side wall 50*b* is configured so that the side wall is lower than the maximum height of the pedestal 10, and thus this prevents collision with the cymbal 7.

Therefore, by screwing against the pedestal holder anchoring wall 4*f*, it is possible to move the pedestal section 10 that is supported by the pedestal holder 50 up and down relative to the cymbal 7 and the actuator 37.

In addition, the adjusting mechanism installed in the electronic high hat cymbal 100 of this preferred embodiment is further comprised of an anchoring ring 51. The anchoring ring 51 is comprises a bottom wall 51*a* and a side wall 51*b*. The bottom wall 51*a* has an opening in the center area through which the pedestal holder anchoring wall 4*f* is passed so that there is play. The side wall 51*b* is placed standing upward from the peripheral edge of the bottom wall 51*a* surrounding the pedestal holder side wall 50*b*, and is screwed onto the pedestal holder side wall 50*b*.

The pedestal holder 50 may be moved up or down as a single unit with the anchoring ring 51 by screwing against the pedestal holder anchoring wall 4*f*, to set the desired position for the pedestal holder 50. After setting the position of the pedestal holder 50, the anchoring ring 51 may be moved by screwing to come in contact with the roof wall 4*e* so that the pedestal holder 50 is firmly anchored at a specified position.

By means of this kind of adjusting mechanism, in those cases where for example, the pedestal holder that is at the position shown in FIG. 11(*a*) has been adjusted and moved to the position shown in FIG. 11(*b*), the space between the upper surface of the upper actuator 37*a* and the upper surface of the pedestal section 10 is changed from t3 to t4 (t3>t4). In other words, after the small adjustment to the position of the actuator 37 in the closed state, it is possible to detect the closed state at the point in time that the bearing 38 has been pressed upward from the initial position.

Conversely, in those cases where, for example, the pedestal holder that is at the position shown in FIG. 11(*b*) has been adjusted and moved to the position that is shown in FIG. 11(*a*), the amount that the actuator 37 is pushed in the closed state is large; and it is possible to detect the closed state at the point in time that the bearing 38 has been pressed downward from the initial position. Accordingly, by merely adjusting the position of the pedestal holder 50, it is possible, in the same manner as has been discussed above, to calibrate for the variations in the specified values that indicates the closed state for each product.

Next, referring to FIG. 12, an explanation will be given regarding the support mechanism in an embodiment of the present invention in which the adjusting mechanism discussed above has been installed. For the electronic high hat cymbal 1 of the previous preferred embodiment, the calibration of the specified value detected by the sheet sensor 40 in the closed state is done by the adjustment of the adjusting screw 30, therefore the support section 28 and the rotation control section 26 must be configured as separate members of the support mechanism.

On the other hand, in those cases where the calibration of the specified value in the closed state is done by adjusting the height of the pedestal section 10 as in the electronic high hat cymbal 100 of the preferred embodiment discussed above (FIG. 12), it is possible to use a support section 60 in which the support section 28 and the rotation control section 26 are made into a single unit.

The support section 60 comprises of a peaked section 60*a* shaped like a mountain viewed in cross-section (a broad base and narrow apex), a hollow body section 60*b* connected to and extends downward from the peaked section 60*a*, and a linking hole 60*c* that passes through the middle of the peaked section 60*a* and is screwed onto one end of the cylindrical section 27. A felt washer 61, a lock nut 62, and the clutch 31 are attached to hold the cymbal 7 between them and the support section 60.

In other words, in those cases where the calibration of the detected specified value for the closed state is done by adjusting the height of the pedestal section 10 as in the electronic high hat cymbal 100 of the current preferred embodiment, since the cymbal 7 is supported by a single-unit support section 60, the number of components is reduced.

An explanation was given above of the present invention based on several preferred embodiments. However, the present invention is in no way limited to the preferred embodiments described above. Various modifications and changes that do not deviate from and are within the scope of the essential aspects of the present invention can be easily surmised.

For example, in the preferred embodiments described above, an explanation was given regarding the case in which a single coil spring 43 is employed to impel the lower actuator 37*b* upward and push the bearing 38 toward the sheet sensor 40. However, different impelling means utilizing a leaf spring or other mechanisms may be employed such that the impelling of the lower actuator 37*b* and the pushing of the bearing 38 are accomplished separately.

What is claimed is:

1. An electronic percussion instrument comprising:

a pedestal that a vertical shaft passes through, a striking surface of a flexible body that moves up and down in response to the movement of the vertical shaft, a first detection section that detects vibrations when the striking surface is struck, a second detection section that detects the vertical displacement of said striking surface, and a single cymbal comprising:

a first frame that supports said striking surface, a second frame attached to the first frame, wherein the second frame forms the bottom surface opposite to said striking surface, a support section through which the shaft passes so that there is play, wherein said support section has a broad base and a narrow apex, and wherein the apex portion of said support section supports the first frame such that swinging is possible with respect to the shaft, and a seating section of the second frame which sits on the pedestal, wherein said seating section is curved on the side facing said pedestal section with a greater radius of curvature than that of the pedestal section, wherein the cymbal is attached to the shaft and moves up and down in conformance with the movement of said shaft, wherein the shaft passes through the first and the second frames with the striking surface on top, wherein a signal based on the detection results of the first and the second detection sections is output to a sound source system, wherein the pedestal is fastened to the shaft at a position lower than that of the cymbal in a state such that there is play, wherein the second frame is seated on the pedestal when the cymbal moves downward in conformance with the movement of the shaft, in the vicinity of where said shaft passes through said second frame, wherein said support section is positioned in the center of the seating section, and wherein the pedestal section forms a hollow in the direction of the curvature of the seating section such that said pedestal section roughly approximates the outer shape of said seating section in the cross-section view.

2. The electronic percussion instrument according to claim 1 further comprising:

a moving section through which the shaft passes such that there is play, wherein the moving section is positioned below the cymbal, wherein the moving section moves downwards in conformance with the movement of the cymbal in those cases when said cymbal moves downward, and wherein the second detection section detects the amount of movement of the moving section electrically.

3. The electronic percussion instrument according to claim 2 further comprising an adjusting section that can be adjusted so that the second detection section detects a specified value in those cases where the seating section has been seated on the pedestal section.

4. The electronic percussion instrument according to claim 3 further comprising:

a contact section through which the shaft passes such that there is play, wherein the contact section can move up and down in conformance with the movement of the cymbal, during which said contact section comes into contact with the moving section, and wherein the adjusting section is structured so that the contact section can move up and down along the shaft relative to the cymbal and the moving section.

5. The electronic percussion instrument according to claim 4 further comprising:

a rotation control section mated with the lower portion of the support section to prevent the rotation of the support section with the shaft at the center, wherein said shaft passes through said rotation control section such that there is play, an impelling section that impels the support section upward with respect to the rotation control section, a cylindrical section that extends from the rotation control section and passes through the support section and the cymbal such that there is play, wherein the shaft passes through the inside of the cylindrical section such that there is play, and a securing section screwed onto the side of the cylindrical section opposite to the rotation control section such that the securing section holds the cymbal between the support section and the securing section, wherein the contact section is engaged with the rotation control section.

6. The electronic percussion instrument according to claims 3, wherein the adjusting section is configured such that the pedestal can move up and down along the shaft relative to the cymbal and the moving section.

7. The electronic percussion instrument according to claims 2, wherein the second frame is connected to the first frame such that an interior space is formed between the second frame and the first frame, and wherein the first detection section is located on the inner surface of the second frame.

8. The electronic percussion instrument according to claims 2 further comprising:

a rolling section fastened to the moving section, wherein the rolling section moves in conformance with the movement of the moving section while rolling on a contact surface of the second detection section, a first impelling section with which the moving section is impelled toward the cymbal, and a second impelling section with which the rolling section is impelled toward said contact surface, wherein the rolling section is in contact with the contact surface of the second detection section, through which the position of said rolling section on said contact surface is detected electrically.

9. The electronic percussion instrument according to claims 2, wherein the moving section comprises:

a first actuator which can rotate with the shaft as the center when the moving section is in contact with the cymbal, and a second actuator that, while supporting the first actuator, cannot rotate with the shaft as the center.

10. The electronic percussion instrument according to claim 9, wherein the rolling section is fastened to the second actuator of the moving section.

11. The electronic percussion instrument according to claim 9, further comprising a coil spring that impels the second actuator toward the first actuator, wherein the coil spring is attached to the second actuator in a twisted state such that the coil spring impels the rolling section toward the contact surface of the second detection section, and wherein the first impelling section and the second impelling section are engaged by the coil spring.

12. The electronic percussion instrument according to claims 8, wherein the second detection section comprises:

a top sheet on which there is a first conducting pattern on the surface opposite to the contact surface, a base sheet on which there is a second conducting pattern that shunts the first conducting pattern on the surface facing the surface of the first conducting pattern of the top sheet, and a spacer sheet that is sandwiched between the base sheet and the top sheet and is placed between the first conducting pattern and the second conducting pattern, wherein the electrical resistance of the second detection section changes in conformance with a change of the position of where the rolling section comes into contact with the contact surface.

13. The electronic percussion instrument according to claims 9, wherein the second detection section comprises:

a top sheet on which there is a first conducting pattern on the surface opposite to the contact surface, a base sheet on which there is a second conducting pattern that shunts the first conducting pattern on the surface facing the surface of the first conducting pattern of the top sheet, and a spacer sheet that is sandwiched between the base sheet and the top sheet and is placed between the first conducting pattern and the second conducting pattern, wherein the electrical resistance of the second detection section changes in conformance with a change of the position of where the rolling section comes into contact with the contact surface.

14. A displacement detection apparatus that detects the displacement of an electronic cymbal in a first direction comprising:

a moving section that is in contact with the electronic cymbal and moves in the first direction in conformance with the movement of the electronic cymbal, a rolling section that is attached to the moving section and moves while rolling up and down on a contact surface in conformance with the movement of the moving section, a detection section that comprises the contact surface that the rolling section is in contact with, wherein the detection section detects the position of the rolling section on the contact surface electrically, a first impelling section that impels the moving section in a direction opposite to the first direction, and a second impelling section that impels the rolling section in the direction of the contact surface, wherein the moving section further comprises a first actuator that can rotate around a central axis and a second actuator supporting the first actuator that cannot rotate around a central axis, wherein said central axis is in the same direction as the first direction which the cymbal moves in.

15. The displacement detection apparatus according to claim 14 wherein the rolling section is fastened to the second actuator of the moving section.

16. The displacement detection apparatus according to claim 14 further comprising a coil spring that impels the second actuator toward the first actuator, wherein the coil is connected to the second actuator in a twisted state to impel the rolling section toward the contact surface, and wherein the first impelling section and the second impelling section are engaged by the coil spring.

17. A displacement detection apparatus that detects the displacement of an electronic cymbal in a first direction comprising:

a moving section that is in contact with the electronic cymbal and moves in the first direction in conformance with the movement of the electronic cymbal, a rolling section that is attached to the moving section and moves while rolling up and down on a contact surface in conformance with the movement of the moving section, a detection section that comprises the contact surface that the rolling section is in contact with, wherein the detection section detects the position of the rolling section on the contact surface electrically, a first impelling section that impels the moving section in a direction opposite to the first direction, and a second impelling section that impels the rolling section in the direction of the contact surface, wherein the detection section further comprises:

a top sheet on which there is a first conducting pattern on the surface opposite to the contact surface, a base sheet on which there is a second conducting pattern that shunts the first conducting pattern on the surface facing the surface of the first conducting pattern of the top sheet, and a spacer sheet that is sandwiched between the base sheet and the top sheet and is placed between the first conducting pattern and the second conducting pattern, and wherein the electrical resistance of the second detection section changes in conformance with a change of the position of where the rolling section comes into contact with the contact surface.

18. A displacement detection apparatus that detects the displacement of an electronic cymbal in a first direction comprising:

a moving section that is in contact with the electronic cymbal and moves in the first direction in conformance with the movement of the electronic cymbal, a rolling section that is attached to the moving section and moves while rolling up and down on a contact surface in conformance with the movement of the moving section, a detection section that comprises the contact surface that the rolling section is in contact with, wherein the detection section detects the position of the rolling section on the contact surface electrically, a first impelling section that impels the moving section in a direction opposite to the first direction, and a second impelling section that impels the rolling section in the direction of the contact surface, wherein the electronic cymbal is a single cymbal comprising:

a striking surface that can be struck by the performer, a first frame that supports the striking surface, and a second frame that is connected to the first frame and forms the bottom surface opposite the striking surface, wherein the first frame and the second frame forms as a single unit, wherein a shaft passes through the first and second frames with the striking surface on top, wherein the cymbal moves up and down in conformance with the movement of the shall, and wherein the moving section comes into contact with the cymbal and moves downward in conformance with the movement of the cymbal in those cases when the cymbal has moved downward in conformance with the movement of the shaft.

19. An electronic percussion instrument comprising:

a single cymbal with a striking surface, a pedestal section, a first detection section that detects vibrations when the striking surface is struck, a second detection section that detects the vertical displacement of the cymbal, and a shaft passing through and attached to the cymbal, said shaft also connected to a pedal, a seating section of the single cymbal which sits on the pedestal section, and a support section with a broad base and narrow apex, wherein the apex of the support section supports the single cymbal such that swinging is possible with respect to the shaft, wherein the cymbal moves up or down in conformance with the movement of the shaft controlled by the pedal, and wherein the cymbal becomes in contact with the pedestal section when it moves downward in conformance with the shaft and becomes out of contact with the pedestal when it moves upward in conformance with the shaft.

20. The displacement detection apparatus according to claim 19, further comprising an adjusting section that can be adjusted so that the second detection section detects a specified value in those cases where the seating section has been seated on the pedestal section.

21. An electronic percussion instrument comprising:

a single cymbal with a striking surface, a pedestal section, a first detection section that detects vibrations when the striking surface is struck, a second detection section that detects the vertical displacement of the cymbal, and a shaft passing through and attached to the cymbal, said shaft also connected to a pedal, a moving section, wherein the cymbal moves up or down in conformance with the movement of the shaft controlled by the pedal, wherein the cymbal becomes in contact with the pedestal section when it moves downward in conformance with the shaft and becomes out of contact with the pedestal when it moves upward in conformance with the shaft, wherein the moving section is supported by a coil spring and positioned below the single cymbal, wherein the moving section moves downward in conformance with the movement of the cymbal in those cases when said cymbal moves downward, and wherein the second detection section detects the amount of movement of the moving section electrically.

22. A displacement detection apparatus that detects the displacement of an electronic cymbal in a first direction comprising:

a moving section that becomes in contact with the electronic cymbal and moves in the first direction in conformance with the movement of the electronic cymbal in the first direction, a detection section that detects the position of the moving section electrically, and a impelling section that impels the moving section in a direction opposite to the first direction, a contact surface on the detection section, and a rolling section attached to the moving section and rolls up and down on the contact surface in conformance of the movement of the moving section, wherein the electrical resistance of the detection section changes in conformance with a change of the position of where the rolling section comes into contact with the contact surface.

23. The displacement detection apparatus according to claim 22, wherein the detection section further comprises:

a top sheet on which there is a first conducting pattern on the surface opposite to the contact surface, a base sheet on which there is a second conducting pattern that shunts the first conducting pattern on the surface facing the surface of the first conducting pattern of the top sheet, and a spacer sheet that is sandwiched between the base sheet and the top sheet and is placed between the first conducting pattern and the second conducting pattern.

* * * * *